US011382190B2

(12) United States Patent
Piel et al.

(10) Patent No.: US 11,382,190 B2
(45) Date of Patent: Jul. 5, 2022

(54) DEFROSTING APPARATUS AND METHODS OF OPERATION THEREOF

(71) Applicant: NXP USA, Inc., Austin, TX (US)

(72) Inventors: Pierre Marie Jean Piel, Chandler, AZ (US); Lionel Mongin, Chandler, AZ (US); Jérémie Simon, Saint Thomas (FR); James Eric Scott, Gilbert, AZ (US); Xiaofei Qiu, Tempe, AZ (US)

(73) Assignee: NXP USA, Inc., Austin, TX (US)

( * ) Notice: Subject to any disclaimer, the term of this patent is extended or adjusted under 35 U.S.C. 154(b) by 414 days.

(21) Appl. No.: 15/923,455

(22) Filed: Mar. 16, 2018

(65) Prior Publication Data

US 2019/0191501 A1 Jun. 20, 2019

(30) Foreign Application Priority Data

Dec. 20, 2017 (EP) ..... 17306854

(51) Int. Cl.
*F25D 21/00* (2006.01)
*H05B 6/80* (2006.01)
(Continued)

(52) U.S. Cl.
CPC ..... *H05B 6/80* (2013.01); *F25D 21/002* (2013.01); *F25D 21/08* (2013.01); *H05B 6/62* (2013.01);
(Continued)

(58) Field of Classification Search
CPC ..... H05B 6/62; H05B 11/00; H05B 3/0014; H05B 6/50; H05B 6/54; H05B 6/647;
(Continued)

(56) References Cited

U.S. PATENT DOCUMENTS 2,868,940 A 1/1959 Jennings et al.
2,921,189 A * 1/1960 Nash ..... H04B 15/06 334/85
(Continued)

FOREIGN PATENT DOCUMENTS

CN 1823683 A 8/2006
CN 101161560 A 4/2008
(Continued)

OTHER PUBLICATIONS

Notice of Allowance; U.S. Appl. No. 15/816,802; 5 pages (dated Jun. 4, 2020).
(Continued)

*Primary Examiner* — Helena Kosanovic
*Assistant Examiner* — Tiffany T Tran
(74) *Attorney, Agent, or Firm* — Sherry Gourlay

(57) ABSTRACT

A defrosting system includes an RF signal source, two electrodes proximate to a cavity within which a load to be defrosted is positioned, a transmission path between the RF signal source and the electrodes, and an impedance matching network electrically coupled along the transmission path between the output of the RF signal source and the electrodes. The system also includes power detection circuitry coupled to the transmission path and configured to detect reflected signal power along the transmission path. A system controller is configured to modify, based on the reflected signal power, a value of a variable passive component of the impedance matching network to reduce the reflected signal power. The impedance matching network may be a single-ended network or a double-ended network.

14 Claims, 11 Drawing Sheets

(51) Int. Cl.

| | |
|---|---|
| ***H05B 6/62*** | (2006.01) |
| ***H05B 6/70*** | (2006.01) |
| ***H05B 6/64*** | (2006.01) |
| ***F25D 21/08*** | (2006.01) |
| *F25D 23/12* | (2006.01) |

(52) U.S. Cl.
CPC ..... *H05B 6/647* (2013.01); *H05B 6/705* (2013.01); *F25D 23/12* (2013.01); *F25D 2400/02* (2013.01)

(58) Field of Classification Search
CPC ..... H05B 6/686; H05B 6/705; H05B 6/80; H05B 6/688; A47J 27/004; A47J 36/32; F25D 21/002; F25D 21/08; F25D 23/12; F25D 2400/02; H03H 7/38; H03H 7/40; H01J 37/32183
USPC ..... 333/17.3; 219/678, 679, 680
See application file for complete search history.

(56) References Cited

U.S. PATENT DOCUMENTS 4,303,820 A 12/1981 Stottmann et al.
4,333,521 A 6/1982 Stottman et al.
4,341,937 A 7/1982 Staats
4,507,530 A 3/1985 Smith
4,771,355 A 9/1988 Emery et al.
4,803,854 A 2/1989 Kikuchi et al.
4,870,235 A 9/1989 Steers et al.
4,874,914 A 10/1989 Eke
4,980,530 A 12/1990 Butot
4,984,015 A 1/1991 Okino
5,036,172 A 7/1991 Kokkeler et al.
5,180,895 A 1/1993 Briggs et al.
5,349,166 A 9/1994 Taylor
5,407,524 A 4/1995 Patrick et al.
5,436,433 A 7/1995 Kim et al.
5,507,055 A 4/1996 Blauert et al.
5,512,736 A 4/1996 Kang et al.
5,585,766 A 12/1996 Shel
5,641,423 A 6/1997 Bridges et al.
5,872,475 A 2/1999 Otaka
6,198,084 B1 3/2001 Kim
6,247,395 B1 6/2001 Yamamoto
6,252,354 B1 6/2001 Collins et al.
6,259,344 B1 7/2001 Heritier-Best et al.
6,657,173 B2 12/2003 Flugstad et al.
6,784,405 B2 8/2004 Flugstad et al.
6,887,339 B1 5/2005 Goodman et al.
7,761,247 B2 7/2010 Van Zyl
8,162,932 B2 4/2012 Podhajsky et al.
8,207,479 B2 6/2012 Ben-Shmuel et al.
8,375,319 B2 2/2013 Decker et al.
8,562,793 B2 10/2013 Novak
8,742,305 B2 6/2014 Simunovic et al.
9,131,543 B2 9/2015 Ben-Shmuel et al.
9,215,756 B2 12/2015 Bilchinsky et al.
9,298,873 B2 3/2016 Ishizuka et al.
9,306,533 B1 4/2016 Mavretic
9,337,000 B2 5/2016 Marakhtanov et al.
9,584,090 B2 2/2017 Mavretic
9,720,022 B2 8/2017 Howald et al.
9,755,576 B2 9/2017 Perreault et al.
9,809,480 B2 11/2017 Stephenson et al.
9,967,925 B2 5/2018 Brill
9,973,167 B2 5/2018 Shi et al.
10,124,187 B2 * 11/2018 Schwarz ..... A61N 2/002
10,433,376 B2 10/2019 Chaimov et al.
2002/0003141 A1 1/2002 Blaker et al.
2002/0046474 A1 4/2002 Novak et al.
2003/0205571 A1 11/2003 Flugstad et al.
2004/0016744 A1 1/2004 Ottaway
2004/0084380 A1 5/2004 Kicinski
2006/0081624 A1 4/2006 Takada et al.
2007/0272358 A1 11/2007 Iseda
2008/0264800 A1 10/2008 Schlager et al.
2008/0314999 A1 12/2008 Strand
2009/0057302 A1 3/2009 Ben-Shmuel et al.
2009/0058550 A1 3/2009 Ella et al.
2009/0194526 A1 8/2009 Buchanan
2010/0141042 A1 6/2010 Kesler et al.
2010/0239757 A1 * 9/2010 Murata ..... C23C 16/509 427/255.28
2010/0247403 A1 9/2010 Hancock
2011/0176911 A1 7/2011 Couturier et al.
2011/0278284 A1 11/2011 Tian et al.
2012/0000888 A1 * 1/2012 Kawasaki ..... H03H 7/38 333/17.3
2012/0067872 A1 3/2012 Libman et al.
2012/0075033 A1 3/2012 Ouyang et al.
2012/0086519 A1 * 4/2012 Hauer ..... H01S 3/09702 333/125
2012/0103973 A1 5/2012 Rogers et al.
2012/0119842 A1 5/2012 Gu et al.
2012/0122072 A1 5/2012 Bilchinsky et al.
2012/0164022 A1 6/2012 Muginstein et al.
2012/0168645 A1 7/2012 Atzmony et al.
2013/0080098 A1 * 3/2013 Hadad ..... G06F 15/00 702/66
2013/0193913 A1 8/2013 Takada et al.
2013/0257667 A1 10/2013 Kang
2013/0284725 A1 10/2013 Bilchinsky et al.
2013/0119055 A1 11/2013 Wohl et al.
2013/0293989 A1 11/2013 Shipley et al.
2013/0334214 A1 12/2013 Yogev et al.
2014/0167878 A1 6/2014 Lee
2014/0287100 A1 9/2014 Libman
2014/0312972 A1 * 10/2014 Yoneda ..... H03F 3/45475 330/260
2015/0091440 A1 4/2015 Marakhtanov et al.
2015/0091441 A1 4/2015 Marakhtanov et al.
2015/0351164 A1 12/2015 Wesson et al.
2016/0095196 A1 3/2016 Chen et al.
2016/0181986 A1 6/2016 Perreault et al.
2016/0221441 A1 8/2016 Hall et al.
2016/0248396 A1 8/2016 Mavretic
2016/0308560 A1 10/2016 Howald et al.
2016/0343548 A1 11/2016 Howald et al.
2017/0096352 A1 4/2017 Hughes et al.
2017/0181455 A1 6/2017 Bullo et al.
2017/0266986 A1 9/2017 Yamada
2017/0302236 A1 * 10/2017 Oshita ..... H03F 1/56
2018/0042073 A1 2/2018 Scott et al.
2018/0042074 A1 2/2018 Qiu et al.
2018/0062605 A1 * 3/2018 Brounley ..... H05B 6/46
2018/0115298 A1 4/2018 Fujimoto et al.
2018/0146518 A1 5/2018 Ma et al.
2018/0220499 A1 8/2018 Sims et al.
2018/0269037 A1 9/2018 Kamarehi et al.
2018/0374685 A1 * 12/2018 Collins ..... H01J 37/32091
2019/0008005 A1 1/2019 Dore et al.
2019/0141799 A1 5/2019 Mongin et al.
2019/0158039 A1 5/2019 Koya et al.
2019/0158055 A1 5/2019 Mongin et al.
2019/0191500 A1 6/2019 Mongin et al.
2019/0306933 A1 10/2019 McCarville et al.
2019/0320506 A1 10/2019 Guatta et al.
2020/0084844 A1 3/2020 Qiu et al.
2020/0092957 A1 3/2020 Ma et al.
2020/0136497 A1 4/2020 Beck
2020/0170081 A1 5/2020 McCarville et al.

FOREIGN PATENT DOCUMENTS

CN 201914941 U 8/2011
CN 102951760 A 3/2013
CN 203021337 U 6/2013
CN 203247118 U 10/2013
CN 103903944 A 7/2014
CN 104782226 A 7/2015
CN 104930804 A 9/2015
CN 105142253 A 12/2015

(56) References Cited

FOREIGN PATENT DOCUMENTS

| | | | |
|---|---|---|---|
| CN | 105206494 | A | 12/2015 |
| CN | 105357788 | A | 2/2016 |
| CN | 105768922 | A | 7/2016 |
| CN | 106225029 | A | 12/2016 |
| CN | 106234557 | A | 12/2016 |
| CN | 106301362 | A | 1/2017 |
| CN | 205860137 | U | 1/2017 |
| CN | 205919380 | U | 2/2017 |
| CN | 206213147 | U | 6/2017 |
| CN | 206227504 | U | 6/2017 |
| CN | 107359705 | A | 11/2017 |
| CN | 107373296 | A | 11/2017 |
| CN | 206724547 | U | 12/2017 |
| CN | 108521691 | A | 9/2018 |
| CN | 108812854 | A | 11/2018 |
| CN | 109000396 | A | 12/2018 |
| CN | 208521691 | U | 2/2019 |
| CN | 104377106 | A | 2/2020 |
| DE | 3818491 | A1 | 12/1989 |
| DE | 112014001599 | T5 | 6/2016 |
| EP | 0 597 497 | A1 | 5/1994 |
| EP | 1 577 281 | A1 | 9/2005 |
| EP | 01818076 | A1 | 8/2007 |
| EP | 2 445 312 | A1 | 4/2012 |
| EP | 3 240 142 | A1 | 11/2017 |
| EP | 3280224 | A1 | 2/2018 |
| EP | 3280225 | A1 | 2/2018 |
| GB | 621320 | | 4/1949 |
| GB | 2465442 | A | 5/2010 |
| JP | S5111237 | A | 1/1976 |
| JP | 55-44199 | | 3/1980 |
| JP | S56-148273 | A | 11/1981 |
| JP | S57129678 | A | 8/1982 |
| JP | S5950305 | | 12/1984 |
| JP | 63-207921 | | 8/1988 |
| JP | H0372840 | A | 3/1991 |
| JP | H0513162 | A | 6/1991 |
| JP | H06215955 | A | 8/1994 |
| JP | H027269868 | A | 10/1995 |
| JP | H08255682 | A | 1/1996 |
| JP | 08-185966 | A | 7/1996 |
| JP | 8-256682 | A | 10/1996 |
| JP | H10134953 | A | 5/1998 |
| JP | 2003 332037 | A | 11/2003 |
| JP | 2003347034 | A | 12/2003 |
| JP | 2003347035 | A | 12/2003 |
| JP | 2004-247128 | | 2/2004 |
| JP | 2004057101 | A | 2/2004 |
| JP | 20040633008 | A | 2/2004 |
| JP | 2004247128 | | 9/2004 |
| JP | 2005056781 | A | 3/2005 |
| JP | 2012207900 | A | 10/2012 |
| JP | 2017 182885 | A | 10/2017 |
| JP | 6375032 | | 8/2018 |
| JP | H0327120 | U | 3/2019 |
| KR | 100133085 | | 4/1998 |
| WO | 2007/117754 | A2 | 10/2007 |
| WO | 2010/060233 | A1 | 6/2010 |
| WO | 2012/001523 | A1 | 1/2012 |
| WO | 2012/024517 | A1 | 2/2012 |
| WO | 2013/033330 | A1 | 3/2013 |
| WO | 2014/006510 | A2 | 1/2014 |
| WO | 2015/028839 | A1 | 3/2015 |
| WO | 2015/052145 | A1 | 4/2015 |
| WO | 2017/017407 | A1 | 2/2017 |
| WO | 2017/123145 | A1 | 7/2017 |
| WO | 2017/144873 | A1 | 8/2017 |
| WO | 2018/223939 | A1 | 12/2018 |
| WO | 2018/223946 | A1 | 12/2018 |

OTHER PUBLICATIONS

Final Office Action; U.S. Appl. No. 15/843,290; 11 pages (dated Apr. 23, 2020).
Final Office Action; U.S. Appl. No. 15/806,075; 11 pages (dated Jun. 19, 2020).
U.S. Appl. No. 16/225,749, filed Dec. 19, 2018; not yet published; 102 pages.
U.S. Appl. No. 16/230,425; not yet published; 122 Pages (dated Dec. 21, 2018).
Non Final Office Action U.S. Appl. No. 15/456,398; 21 pages (dated Jan. 21, 2020).
Notice of Allowance; U.S. Appl. No. 15/843,290; 7 pages (dated Jul. 31, 2020).
Final Office Action; U.S. Appl. No. 15/456,398; 28 pages (dated Jul. 22, 2020).
Non Final Office Action; U.S. Appl. No. 16/126,963; 15 pages (dated Jul. 28, 2020).
Non Final Office Action; U.S. Appl. No. 16/917,035; 13 pages (dated Aug. 3, 2020).
Non Final Office Action; U.S. Appl. No. 15/454,345; 17 pages (dated Jun. 12, 2019).
Doherty, Mark F. et al; "Automatic Detection of Mass-Resolved Ion Conics"; IEEE Transactions on Geoscience and Remote Sensing, vol. 31, No. 2; 10 pages (Mar. 1993).
Cottee et al; "Design of Matching Circuit Controllers for Radio-Frequency Healing"; (Jan. 2003).
Ameri, M. et al.; "Pattern Matching Algorithm for Identification of Load Mass of an Elastic Robot Arm"; American Control Conference; 2 pages (1988).
Non Final Office Action; U.S. Appl. No. 15/816,802; 22 pages dated Feb. 20, 2020.
Notice of Allowance; U.S. Appl. No. 15/454,345; 9 pages (dated Jan. 15, 2020).
Non Final Office Action; U.S. Appl. No. 15/806,075; 9 pages (dated Dec. 11, 2019).
Notice of Allowance; U.S. Appl. No. 15/806,075; 10 pages (dated Oct. 5, 2020).
Non Final Rejection; U.S. Appl. No. 16/131,636; 20 pages (dated Feb. 23, 2021).
Notice of Allowance; U.S. Appl. No. 16/126,963; 8 pages (dated Dec. 31, 2020).
Notice of Allowance; U.S. Appl. No. 15/456,398; pages (dated Apr. 6, 2021).
Non Final Office Action; U.S. Appl. No. 16/225,749; 10 pages (dated Apr. 7, 2021).
Final Office Action; U.S. Appl. No. 16/225,749; 8 pages (dated Aug. 20, 2021).
Non Final Office Action; U.S. Appl. No. 16/225,749; 8 pages (dated Apr. 7, 2021).
Non Final Office Action; U.S. Appl. No. 16/360,144; 9 pages (dated Dec. 10, 2021).
Wang, Chong-hao et al; "Research Progress of Cleaning and Thawing Equipment on Meat Food"; School of Energy and Power Engineering, University of Shanghai for Science and Technology, Shanghai, CN; English abstract; 5 pages (Apr. 2017).
Final Office Action; U.S. Appl. No. 16/131,636; 22 pages dated Jul. 7, 2021.
Notice of Allowance; U.S. Appl. No. 16/230,425 10 pages (dated Apr. 21, 2021).
Notice of Allowance; U.S. Appl. No. 16/225,749; 5 pages (dated Sep. 22, 2021).
Non Final Office Action; U.S. Appl. No. 16/131,636; 26 pages (dated Mar. 29, 2022).
Notice of Allowance ; U.S. Appl. No. 16/360,144; 8 pages (dated Apr. 4, 2022).

* cited by examiner

DEFROSTING APPARATUS AND METHODS OF OPERATION THEREOF

TECHNICAL FIELD

Embodiments of the subject matter described herein relate generally to apparatus and methods of defrosting a load using radio frequency (RF) energy.

BACKGROUND

Conventional capacitive food defrosting (or thawing) systems include large planar electrodes contained within a heating compartment. After a food load is placed between the electrodes and the electrodes are brought into contact with the food load, low power electromagnetic energy is supplied to the electrodes to provide gentle warming of the food load. As the food load thaws during the defrosting operation, the impedance of the food load changes. Accordingly, the power transfer to the food load also changes during the defrosting operation. The duration of the defrosting operation may be determined, for example, based on the weight of the food load, and a timer may be used to control cessation of the operation.

Although good defrosting results are possible using such systems, the dynamic changes to the food load impedance may result in inefficient defrosting of the food load. In addition, inaccuracies inherent in determining the duration of the defrosting operation based on weight may result in premature cessation of the defrosting operation, or late cessation after the food load has begun to cook. What are needed are apparatus and methods for defrosting food loads (or other types of loads) that may result in efficient and even defrosting throughout the load and cessation of the defrosting operation when the load is at a desired temperature.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
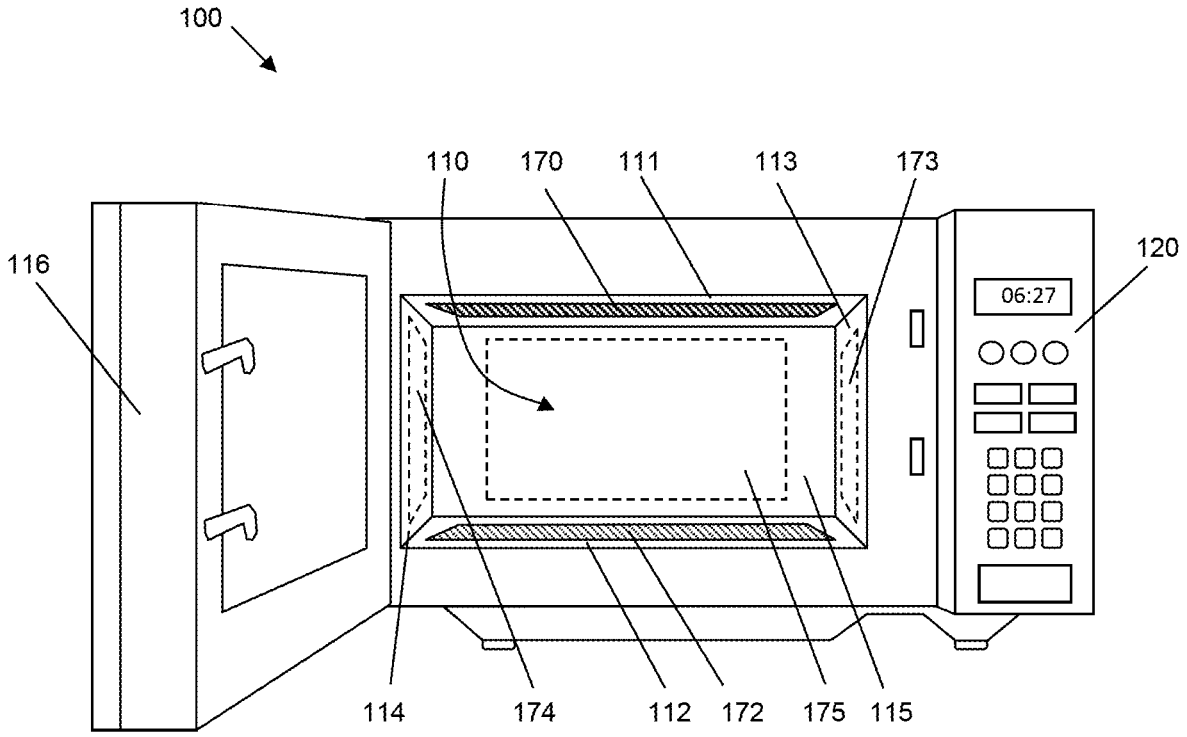
FIG. 1 is a perspective view of a defrosting appliance, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the subject matter described herein relate to solid-state defrosting apparatus that may be incorporated into stand-alone appliances or into other systems. As described in greater detail below, embodiments of solid-state defrosting apparatus include both "unbalanced" defrosting apparatus and "balanced" apparatus. For example, exemplary "unbalanced" defrosting systems are realized using a first electrode disposed in a cavity, a single-ended amplifier arrangement (including one or more transistors), a single-ended impedance matching network coupled between an output of the amplifier arrangement and the first electrode, and a measurement and control system that can detect when a defrosting operation has completed. In contrast, exemplary "balanced" defrosting systems are realized using first and second electrodes disposed in a cavity, a single-ended or double-ended amplifier arrangement (including one or more transistors), a double-ended impedance matching network coupled between an output of the amplifier arrangement and the first and second electrodes, and a measurement and control system that can detect when a defrosting operation has completed. In various embodiments, the impedance matching network includes a variable impedance matching network that can be adjusted during the defrosting operation to improve matching between the amplifier arrangement and the cavity.

Generally, the term "defrosting" means to elevate the temperature of a frozen load (e.g., a food load or other type of load) to a temperature at which the load is no longer frozen (e.g., a temperature at or near 0 degrees Celsius). As used herein, the term "defrosting" more broadly means a process by which the thermal energy or temperature of a load (e.g., a food load or other type of load) is increased through provision of RF power to the load. Accordingly, in various embodiments, a "defrosting operation" may be performed on a load with any initial temperature (e.g., any initial temperature above or below 0 degrees Celsius), and the defrosting operation may be ceased at any final temperature that is higher than the initial temperature (e.g., including final temperatures that are above or below 0 degrees Celsius). That said, the "defrosting operations" and "defrosting systems" described herein alternatively may be referred to as "thermal increase operations" and "thermal increase systems." The term "defrosting" should not be construed to limit application of the invention to methods or systems that are only capable of raising the temperature of a frozen load to a temperature at or near 0 degrees Celsius.

FIG. 1 is a perspective view of a defrosting system 100, in accordance with an example embodiment. Defrosting system 100 includes a defrosting cavity 110 (e.g., cavity 360, 960, FIGS. 3, 9), a control panel 120, one or more radio frequency (RF) signal sources (e.g., RF signal source 320, 920, FIGS. 3, 9), a power supply (e.g., power supply 326, 926, FIGS. 3, 9), a first electrode 170 (e.g., electrode 340, 940, FIGS. 3, 9), a second electrode 172 (e.g., electrode 950, FIG. 9), impedance matching circuitry (e.g., circuits 334, 370, 934, 972, FIGS. 3, 9), power detection circuitry (e.g., power detection circuitry 330, 930, FIGS. 3, 9), and a system controller (e.g., system controller 312, 912, FIGS. 3, 9). The defrosting cavity 110 is defined by interior surfaces of top, bottom, side, and back cavity walls 111, 112, 113, 114, 115 and an interior surface of door 116. With door 116 closed, the defrosting cavity 110 defines an enclosed air cavity. As used herein, the term "air cavity" may mean an enclosed area that contains air or other gasses (e.g., defrosting cavity 110).

According to an "unbalanced" embodiment, the first electrode 170 is arranged proximate to a cavity wall (e.g., top wall 111), the first electrode 170 is electrically isolated from the remaining cavity walls (e.g., walls 112-115 and door 116), and the remaining cavity walls are grounded. In such a configuration, the system may be simplistically modeled as a capacitor, where the first electrode 170 functions as one conductive plate (or electrode), the grounded cavity walls (e.g., walls 112-115) function as a second conductive plate (or electrode), and the air cavity (including any load contained therein) function as a dielectric medium between the first and second conductive plates. Although not shown in FIG. 1, a non-electrically conductive barrier (e.g., barrier 362, 962, FIGS. 3, 9) also may be included in the system 100, and the non-conductive barrier may function to electrically and physically isolate the load from the bottom cavity wall 112. Although FIG. 1 shows the first electrode 170 being proximate to the top wall 111, the first electrode 170 alternatively may be proximate to any of the other walls 112-115, as indicated by electrodes 172-175.

According to a "balanced" embodiment, the first electrode 170 is arranged proximate to a first cavity wall (e.g., top wall 111), a second electrode 172 is arranged proximate to an opposite, second cavity wall (e.g., bottom wall 112), and the first and second electrodes 170, 172 are electrically isolated from the remaining cavity walls (e.g., walls 113-115 and door 116). In such a configuration, the system also may be simplistically modeled as a capacitor, where the first electrode 170 functions as one conductive plate (or electrode), the second electrode 172 functions as a second conductive plate (or electrode), and the air cavity (including any load contained therein) function as a dielectric medium between the first and second conductive plates. Although not shown in FIG. 1, a non-electrically conductive barrier (e.g., barrier 914, FIG. 9) also may be included in the system 100, and the non-conductive barrier may function to electrically and physically isolate the load from the second electrode 172 and the bottom cavity wall 112. Although FIG. 1 shows the first electrode 170 being proximate to the top wall 111, and the second electrode 172 being proximate to the bottom wall 112, the first and second electrodes 170, 172 alternatively may be proximate to other opposite walls (e.g., the first electrode may be electrode 173 proximate to wall 113, and the second electrode may be electrode 174 proximate to wall 114.

According to an embodiment, during operation of the defrosting system 100, a user (not illustrated) may place one or more loads (e.g., food and/or liquids) into the defrosting cavity 110, and optionally may provide inputs via the control panel 120 that specify characteristics of the load(s). For example, the specified characteristics may include an approximate weight of the load. In addition, the specified load characteristics may indicate the material(s) from which the load is formed (e.g., meat, bread, liquid). In alternate embodiments, the load characteristics may be obtained in some other way, such as by scanning a barcode on the load packaging or receiving a radio frequency identification (RFID) signal from an RFID tag on or embedded within the load. Either way, as will be described in more detail later, information regarding such load characteristics enables the system controller (e.g., system controller 312, 912, FIGS. 3, 9) to establish an initial state for the impedance matching network of the system at the beginning of the defrosting operation, where the initial state may be relatively close to an optimal state that enables maximum RF power transfer into the load. Alternatively, load characteristics may not be entered or received prior to commencement of a defrosting operation, and the system controller may establish a default initial state for the impedance matching network.

To begin the defrosting operation, the user may provide an input via the control panel 120. In response, the system controller causes the RF signal source(s) (e.g., RF signal source 320, 920, FIGS. 3, 9) to supply an RF signal to the first electrode 170 in an unbalanced embodiment, or to both the first and second electrodes 170, 172 in a balanced embodiment, and the electrode(s) responsively radiate electromagnetic energy into the defrosting cavity 110. The electromagnetic energy increases the thermal energy of the load (i.e., the electromagnetic energy causes the load to warm up).

During the defrosting operation, the impedance of the load (and thus the total input impedance of the cavity 110 plus load) changes as the thermal energy of the load increases. The impedance changes alter the absorption of RF energy into the load, and thus alter the magnitude of reflected power. According to an embodiment, power detection circuitry (e.g., power detection circuitry 330, 930, FIGS. 3, 9) continuously or periodically measures the reflected power along a transmission path (e.g., transmission path 328, 928, FIGS. 3, 9) between the RF signal source (e.g., RF signal source 320, 920, FIGS. 3, 9) and the electrode(s) 170, 172. Based on these measurements, the system controller (e.g., system controller 312, 912, FIGS. 3, 9) may detect completion of the defrosting operation, as will be described in detail below. According to a further embodiment, the impedance matching network is variable, and based on the reflected power measurements (or both the forward and reflected power measurements), the system controller may alter the state of the impedance matching network during the defrosting operation to increase the absorption of RF power by the load.

Figure 2:
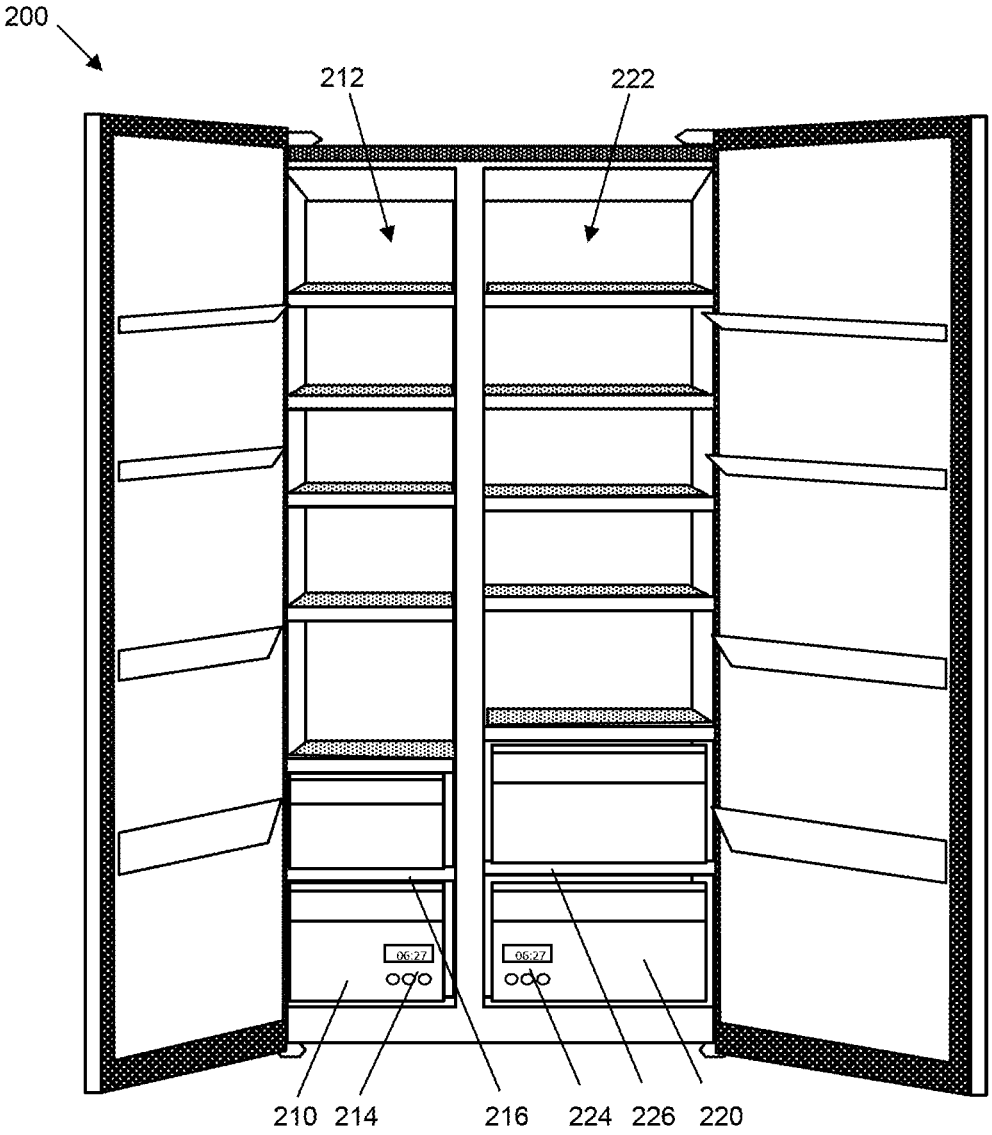
FIG. 2 is a perspective view of a refrigerator/freezer appliance that includes other example embodiments of defrosting systems.

The defrosting system 100 of FIG. 1 is embodied as a counter-top type of appliance. In a further embodiment, the defrosting system 100 also may include components and functionality for performing microwave cooking operations. Alternatively, components of a defrosting system may be incorporated into other types of systems or appliances. For example, FIG. 2 is a perspective view of a refrigerator/freezer appliance 200 that includes other example embodiments of defrosting systems 210, 220. More specifically, defrosting system 210 is shown to be incorporated within a freezer compartment 212 of the system 200, and defrosting system 220 is shown to be incorporated within a refrigerator compartment 222 of the system. An actual refrigerator/freezer appliance likely would include only one of the defrosting systems 210, 220, but both are shown in FIG. 2 to concisely convey both embodiments.

Figure 3:
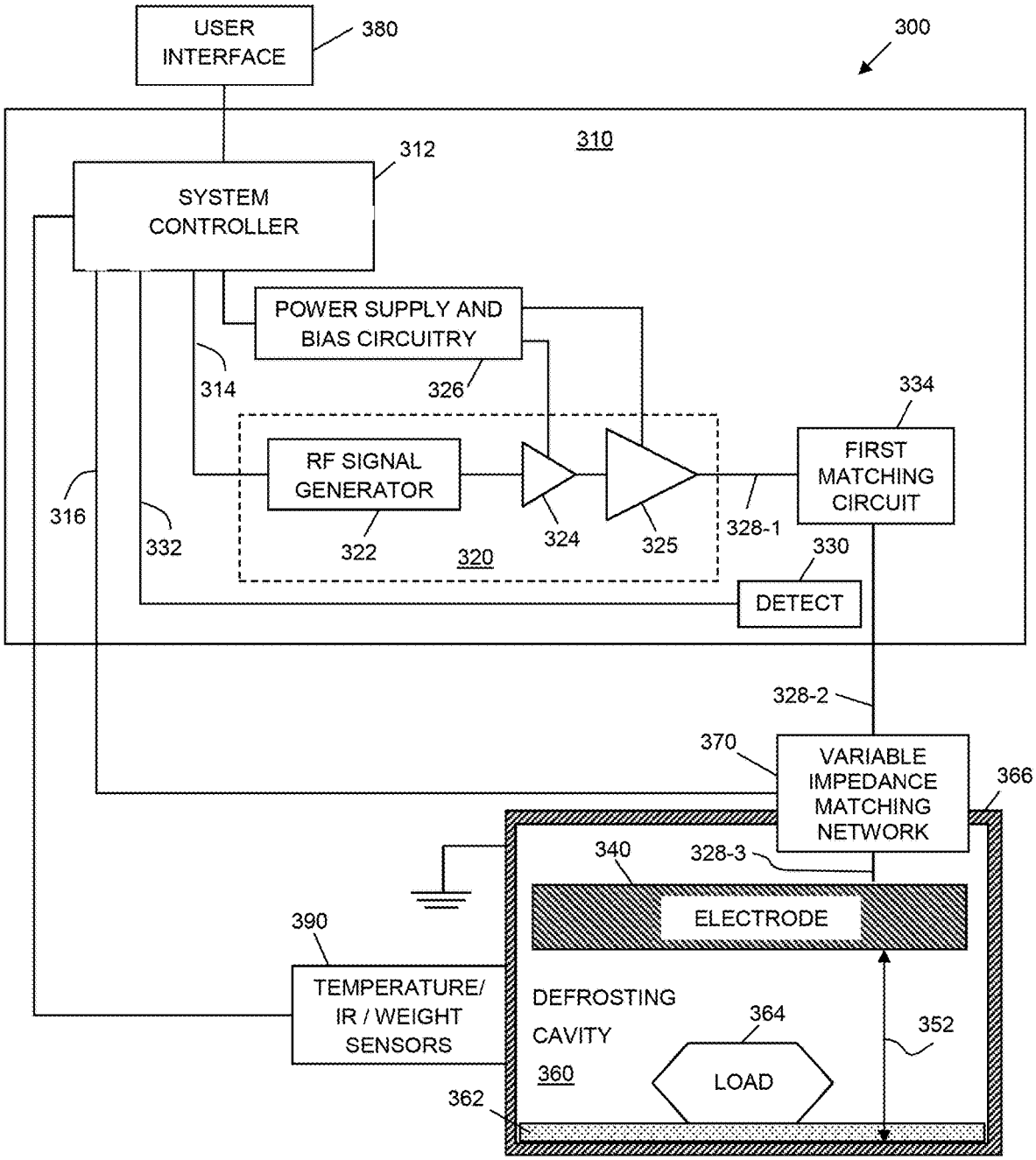
FIG. 3 is a simplified block diagram of an unbalanced defrosting apparatus, in accordance with an example embodiment.
Figure 9:
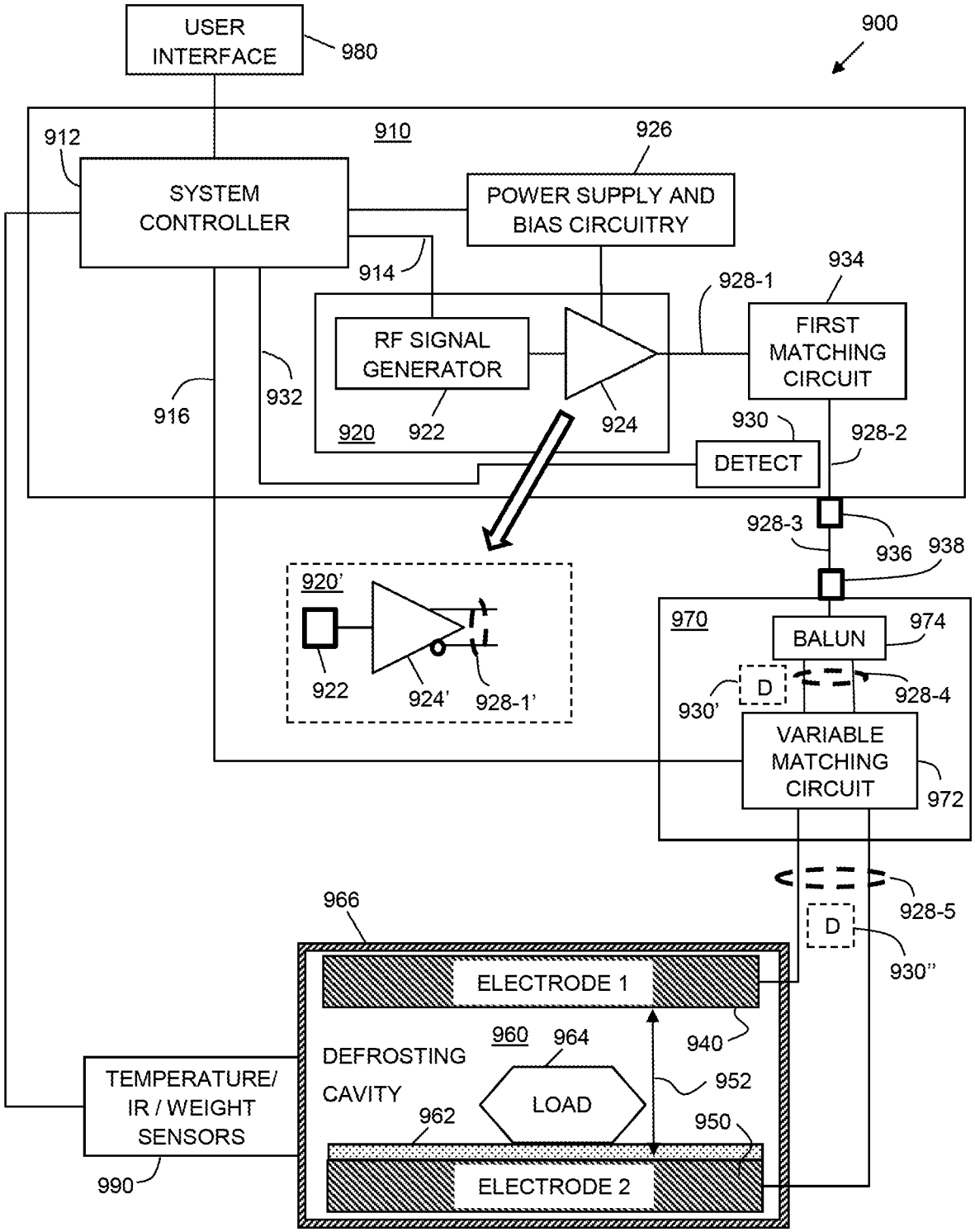
FIG. 9 is a simplified block diagram of a balanced defrosting apparatus, in accordance with another example embodiment.

Similar to the defrosting system 100, each of defrosting systems 210, 220 includes a defrosting cavity, a control panel 214, 224, one or more RF signal sources (e.g., RF signal source 320, 920, FIGS. 3, 9), a power supply (e.g., power supply 326, 926, FIGS. 3, 9), a first electrode (e.g., electrode 340, 940, FIGS. 3, 9), a second electrode 172 (e.g., containment structure 366, electrode 950, FIGS. 3, 9), impedance matching circuitry (e.g., circuits 334, 370, 934, 972, FIGS. 3, 9), power detection circuitry (e.g., power detection circuitry 330, 930, FIGS. 3, 9), and a system controller (e.g., system controller 312, 912, FIGS. 3, 9). For example, the defrosting cavity may be defined by interior surfaces of bottom, side, front, and back walls of a drawer, and an interior top surface of a fixed shelf 216, 226 under which the drawer slides. With the drawer slid fully under the shelf, the drawer and shelf define the cavity as an enclosed air cavity. The components and functionalities of the defrosting systems 210, 220 may be substantially the same as the components and functionalities of defrosting system 100, in various embodiments.

In addition, according to an embodiment, each of the defrosting systems 210, 220 may have sufficient thermal communication with the freezer or refrigerator compartment 212, 222, respectively, in which the system 210, 220 is disposed. In such an embodiment, after completion of a defrosting operation, the load may be maintained at a safe temperature (i.e., a temperature at which food spoilage is retarded) until the load is removed from the system 210, 220. More specifically, upon completion of a defrosting operation by the freezer-based defrosting system 210, the cavity within which the defrosted load is contained may thermally communicate with the freezer compartment 212, and if the load is not promptly removed from the cavity, the load may re-freeze. Similarly, upon completion of a defrosting operation by the refrigerator-based defrosting system 220, the cavity within which the defrosted load is contained may thermally communicate with the refrigerator compartment 222, and if the load is not promptly removed from the cavity, the load may be maintained in a defrosted state at the temperature within the refrigerator compartment 222.

Those of skill in the art would understand, based on the description herein, that embodiments of defrosting systems may be incorporated into systems or appliances having other configurations, as well. Accordingly, the above-described implementations of defrosting systems in a stand-alone appliance, a microwave oven appliance, a freezer, and a refrigerator are not meant to limit use of the embodiments only to those types of systems.

Although defrosting systems 100, 200 are shown with their components in particular relative orientations with respect to one another, it should be understood that the various components may be oriented differently, as well. In addition, the physical configurations of the various components may be different. For example, control panels 120, 214, 224 may have more, fewer, or different user interface elements, and/or the user interface elements may be differently arranged. In addition, although a substantially cubic defrosting cavity 110 is illustrated in FIG. 1, it should be understood that a defrosting cavity may have a different shape, in other embodiments (e.g., cylindrical, and so on). Further, defrosting systems 100, 210, 220 may include additional components (e.g., a fan, a stationary or rotating plate, a tray, an electrical cord, and so on) that are not specifically depicted in FIGS. 1, 2.

FIG. 3 is a simplified block diagram of an unbalanced defrosting system 300 (e.g., defrosting system 100, 210, 220, FIGS. 1, 2), in accordance with an example embodiment. Defrosting system 300 includes RF subsystem 310, defrosting cavity 360, user interface 380, system controller 312, RF signal source 320, power supply and bias circuitry 326, variable impedance matching network 370, electrode 340, containment structure 366, and power detection circuitry 330, in an embodiment. In addition, in other embodiments, defrosting system 300 may include temperature sensor(s), infrared (IR) sensor(s), and/or weight sensor(s) 390, although some or all of these sensor components may be excluded. It should be understood that FIG. 3 is a simplified representation of a defrosting system 300 for purposes of explanation and ease of description, and that practical embodiments may include other devices and components to provide additional functions and features, and/or the defrosting system 300 may be part of a larger electrical system.

User interface 380 may correspond to a control panel (e.g., control panel 120, 214, 224, FIGS. 1, 2), for example, which enables a user to provide inputs to the system regarding parameters for a defrosting operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting operation (e.g., a countdown timer, visible indicia indicating progress or completion of the defrosting operation, and/or audible tones indicating completion of the defrosting operation) and other information.

Some embodiments of defrosting system 300 may include temperature sensor(s), IR sensor(s), and/or weight sensor(s) 390. The temperature sensor(s) and/or IR sensor(s) may be positioned in locations that enable the temperature of the load 364 to be sensed during the defrosting operation. When provided to the system controller 312, the temperature information enables the system controller 312 to alter the power of the RF signal supplied by the RF signal source 320 (e.g., by controlling the bias and/or supply voltages provided by the power supply and bias circuitry 326), to adjust the state of the variable impedance matching network 370, and/or to determine when the defrosting operation should be terminated. The weight sensor(s) are positioned under the load 364, and are configured to provide an estimate of the weight of the load 364 to the system controller 312. The system controller 312 may use this information, for example, to determine a desired power level for the RF signal supplied by the RF signal source 320, to determine an initial setting for the variable impedance matching network 370, and/or to determine an approximate duration for the defrosting operation.

The RF subsystem 310 includes a system controller 312, an RF signal source 320, first impedance matching circuit 334 (herein "first matching circuit"), power supply and bias circuitry 326, and power detection circuitry 330, in an embodiment. System controller 312 may include one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, system controller 312 is coupled to user interface 380, RF signal source 320, variable impedance matching network 370, power detection circuitry 330, and sensors 390 (if included). System controller 312 is configured to receive signals indicating user inputs received via user interface 380, and to receive signals indicating RF signal reflected power (and possibly RF signal forward power) from power detection circuitry 330. Responsive to the received signals and measurements, and as will be described in more detail later, system controller 312 provides control signals to the power supply and bias circuitry 326 and to the RF signal generator 322 of the RF signal source 320. In addition, system controller 312 provides control signals to the variable impedance matching network 370, which cause the network 370 to change its state or configuration.

Defrosting cavity 360 includes a capacitive defrosting arrangement with first and second parallel plate electrodes that are separated by an air cavity within which a load 364 to be defrosted may be placed. For example, a first electrode 340 may be positioned above the air cavity, and a second electrode may be provided by a portion of a containment structure 366. More specifically, the containment structure 366 may include bottom, top, and side walls, the interior surfaces of which define the cavity 360 (e.g., cavity 110, FIG. 1). According to an embodiment, the cavity 360 may be sealed (e.g., with a door 116, FIG. 1 or by sliding a drawer closed under a shelf 216, 226, FIG. 2) to contain the electromagnetic energy that is introduced into the cavity 360 during a defrosting operation. The system 300 may include one or more interlock mechanisms that ensure that the seal is intact during a defrosting operation. If one or more of the interlock mechanisms indicates that the seal is breached, the system controller 312 may cease the defrosting operation. According to an embodiment, the containment structure 366 is at least partially formed from conductive material, and the conductive portion(s) of the containment structure may be grounded. Alternatively, at least the portion of the containment structure 366 that corresponds to the bottom surface of the cavity 360 may be formed from conductive material and grounded. Either way, the containment structure 366 (or at least the portion of the containment structure 366 that is parallel with the first electrode 340) functions as a second electrode of the capacitive defrosting arrangement. To avoid direct contact between the load 364 and the grounded bottom surface of the cavity 360, a non-conductive barrier 362 may be positioned over the bottom surface of the cavity 360.

Essentially, defrosting cavity 360 includes a capacitive defrosting arrangement with first and second parallel plate electrodes 340, 366 that are separated by an air cavity within which a load 364 to be defrosted may be placed. The first electrode 340 is positioned within containment structure 366 to define a distance 352 between the electrode 340 and an opposed surface of the containment structure 366 (e.g., the bottom surface, which functions as a second electrode), where the distance 352 renders the cavity 360 a sub-resonant cavity, in an embodiment.

In various embodiments, the distance 352 is in a range of about 0.10 meters to about 1.0 meter, although the distance may be smaller or larger, as well. According to an embodiment, distance 352 is less than one wavelength of the RF signal produced by the RF subsystem 310. In other words, as mentioned above, the cavity 360 is a sub-resonant cavity. In some embodiments, the distance 352 is less than about half of one wavelength of the RF signal. In other embodiments, the distance 352 is less than about one quarter of one wavelength of the RF signal. In still other embodiments, the distance 352 is less than about one eighth of one wavelength of the RF signal. In still other embodiments, the distance 352 is less than about one 50th of one wavelength of the RF signal. In still other embodiments, the distance 352 is less than about one 100th of one wavelength of the RF signal.

In general, a system 300 designed for lower operational frequencies (e.g., frequencies between 10 MHz and 100 MHz) may be designed to have a distance 352 that is a smaller fraction of one wavelength. For example, when system 300 is designed to produce an RF signal with an operational frequency of about 10 MHz (corresponding to a wavelength of about 30 meters), and distance 352 is selected to be about 0.5 meters, the distance 352 is about one 60th of one wavelength of the RF signal. Conversely, when system 300 is designed for an operational frequency of about 300 MHz (corresponding to a wavelength of about 1 meter), and distance 352 is selected to be about 0.5 meters, the distance 352 is about one half of one wavelength of the RF signal.

With the operational frequency and the distance 352 between electrode 340 and containment structure 366 being selected to define a sub-resonant interior cavity 360, the first electrode 340 and the containment structure 366 are capacitively coupled. More specifically, the first electrode 340 may be analogized to a first plate of a capacitor, the containment structure 366 may be analogized to a second plate of a capacitor, and the load 364, barrier 362, and air within the cavity 360 may be analogized to a capacitor dielectric. Accordingly, the first electrode 340 alternatively may be referred to herein as an "anode," and the containment structure 366 may alternatively be referred to herein as a "cathode."

Essentially, the voltage across the first electrode 340 and the containment structure 366 heats the load 364 within the cavity 360. According to various embodiments, the RF subsystem 310 is configured to generate the RF signal to produce voltages between the electrode 340 and the containment structure 366 in a range of about 90 volts to about 3,000 volts, in one embodiment, or in a range of about 3000 volts to about 10,000 volts, in another embodiment, although the system may be configured to produce lower or higher voltages between the electrode 340 and the containment structure 366, as well.

The first electrode 340 is electrically coupled to the RF signal source 320 through a first matching circuit 334, a variable impedance matching network 370, and a conductive transmission path, in an embodiment. The first matching circuit 334 is configured to perform an impedance transformation from an impedance of the RF signal source 320 (e.g., less than about 10 ohms) to an intermediate impedance (e.g., 50 ohms, 75 ohms, or some other value). According to an embodiment, the conductive transmission path includes a plurality of conductors 328-1, 328-2, and 328-3 connected in series, and referred to collectively as transmission path 328. According to an embodiment, the conductive transmission path 328 is an "unbalanced" path, which is configured to carry an unbalanced RF signal (i.e., a single RF signal referenced against ground). In some embodiments, one or more connectors (not shown, but each having male and female connector portions) may be electrically coupled along the transmission path 328, and the portion of the transmission path 328 between the connectors may comprise a coaxial cable or other suitable connector. Such a connection is shown in FIG. 9 and described later (e.g., including connectors 936, 938 and a conductor 928-3 such as a coaxial cable between the connectors 936, 938).

As will be described in more detail later, the variable impedance matching circuit 370 is configured to perform an impedance transformation from the above-mentioned intermediate impedance to an input impedance of defrosting cavity 320 as modified by the load 364 (e.g., on the order of hundreds or thousands of ohms, such as about 1000 ohms to about 4000 ohms or more). In an embodiment, the variable impedance matching network 370 includes a network of passive components (e.g., inductors, capacitors, resistors). According to a more specific embodiment, the variable impedance matching network 370 includes a plurality of fixed-value lumped inductors (e.g., inductors 412-414, 712-714, 812-814, FIGS. 4, 7, 8) that are positioned within the cavity 360 and which are electrically coupled to the first electrode 340. In addition, the variable impedance matching network 370 includes a plurality of variable inductance networks (e.g., networks 410, 411, 500, FIGS. 4, 5), which may be located inside or outside of the cavity 360. The inductance value provided by each of the variable inductance networks is established using control signals from the system controller 312, as will be described in more detail later. In any event, by changing the state of the variable impedance matching network 370 over the course of a defrosting operation to dynamically match the ever-changing cavity input impedance, the amount of RF power that is absorbed by the load 364 may be maintained at a high level despite variations in the load impedance during the defrosting operation.

According to an embodiment, RF signal source 326 includes an RF signal generator 322 and a power amplifier (e.g., including one or more power amplifier stages 324, 325). In response to control signals provided by system controller 312 over connection 314, RF signal generator 322 is configured to produce an oscillating electrical signal having a frequency in the ISM (industrial, scientific, and medical) band, although the system could be modified to support operations in other frequency bands, as well. The RF signal generator 322 may be controlled to produce oscillating signals of different power levels and/or different frequencies, in various embodiments. For example, the RF signal generator 322 may produce a signal that oscillates in a range of about 10.0 megahertz (MHz) to about 100 MHz and/or from about 100 MHz to about 3.0 gigahertz (GHz). Some desirable frequencies may be, for example, 13.56 MHz (+/−5 percent), 27.125 MHz (+/−5 percent), 40.68 MHz (+/−5 percent), and 2.45 GHz (+/−5 percent). In one particular embodiment, for example, the RF signal generator 322 may produce a signal that oscillates in a range of about 40.66 MHz to about 40.70 MHz and at a power level in a range of about 10 decibels (dB) to about 15 dB. Alternatively, the frequency of oscillation and/or the power level may be lower or higher.

In the embodiment of FIG. 3, the power amplifier includes a driver amplifier stage 324 and a final amplifier stage 325. The power amplifier is configured to receive the oscillating signal from the RF signal generator 322, and to amplify the signal to produce a significantly higher-power signal at an output of the power amplifier. For example, the output signal may have a power level in a range of about 100 watts to about 400 watts or more. The gain applied by the power amplifier may be controlled using gate bias voltages and/or drain supply voltages provided by the power supply and bias circuitry 326 to each amplifier stage 324, 325. More specifically, power supply and bias circuitry 326 provides bias and supply voltages to each RF amplifier stage 324, 325 in accordance with control signals received from system controller 312.

In an embodiment, each amplifier stage 324, 325 is implemented as a power transistor, such as a field effect transistor (FET), having an input terminal (e.g., a gate or control terminal) and two current carrying terminals (e.g., source and drain terminals). Impedance matching circuits (not illustrated) may be coupled to the input (e.g., gate) of the driver amplifier stage 324, between the driver and final amplifier stages 325, and/or to the output (e.g., drain terminal) of the final amplifier stage 325, in various embodiments. In an embodiment, each transistor of the amplifier stages 324, 325 includes a laterally diffused metal oxide semiconductor FET (LDMOSFET) transistor. However, it should be noted that the transistors are not intended to be limited to any particular semiconductor technology, and in other embodiments, each transistor may be realized as a gallium nitride (GaN) transistor, another type of MOSFET transistor, a bipolar junction transistor (BJT), or a transistor utilizing another semiconductor technology.

In FIG. 3, the power amplifier arrangement is depicted to include two amplifier stages 324, 325 coupled in a particular manner to other circuit components. In other embodiments, the power amplifier arrangement may include other amplifier topologies and/or the amplifier arrangement may include only one amplifier stage (e.g., as shown in the embodiment of amplifier 924, FIG. 9), or more than two amplifier stages. For example, the power amplifier arrangement may include various embodiments of a single-ended amplifier, a Doherty amplifier, a Switch Mode Power Amplifier (SMPA), or another type of amplifier.

Defrosting cavity 360 and any load 364 (e.g., food, liquids, and so on) positioned in the defrosting cavity 360 present a cumulative load for the electromagnetic energy (or RF power) that is radiated into the cavity 360 by the first electrode 340. More specifically, the cavity 360 and the load 364 present an impedance to the system, referred to herein as a "cavity input impedance." The cavity input impedance changes during a defrosting operation as the temperature of the load 364 increases. The cavity input impedance has a direct effect on the magnitude of reflected signal power along the conductive transmission path 328 between the RF signal source 320 and electrodes 340. In most cases, it is desirable to maximize the magnitude of transferred signal power into the cavity 360, and/or to minimize the reflected-to-forward signal power ratio along the conductive transmission path 328.

In order to at least partially match the output impedance of the RF signal generator 320 to the chamber input impedance, a first matching circuit 334 is electrically coupled along the transmission path 328, in an embodiment. The first matching circuit 334 may have any of a variety of configurations. According to an embodiment, the first matching circuit 334 includes fixed components (i.e., components with non-variable component values), although the first matching circuit 334 may include one or more variable components, in other embodiments. For example, the first matching circuit 334 may include any one or more circuits selected from an inductance/capacitance (LC) network, a series inductance network, a shunt inductance network, or a combination of bandpass, high-pass and low-pass circuits, in various embodiments. Essentially, the fixed matching circuit 334 is configured to raise the impedance to an intermediate level between the output impedance of the RF signal generator 320 and the chamber input impedance.

Figure 15:
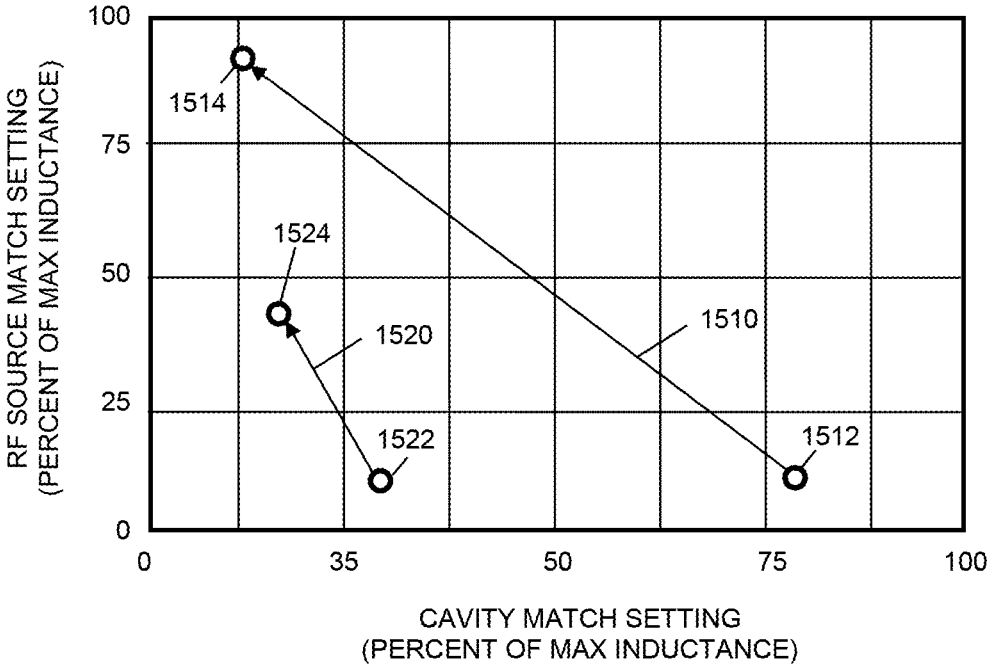
FIG. 15 is a chart plotting cavity match setting versus RF signal source match setting through a defrost operation for two different loads.

As will be described in conjunction with FIG. 15 later, the impedance of many types of food loads changes with respect to temperature in a somewhat predictable manner as the food load transitions from a frozen state to a defrosted state. According to an embodiment, based on reflected power measurements (and forward power measurements, in some embodiments) from the power detection circuitry 330, the system controller 312 is configured to identify a point in time during a defrosting operation when the rate of change of cavity input impedance indicates that the load 364 is approaching 0° Celsius, at which time the system controller 312 may terminate the defrosting operation.

According to an embodiment, power detection circuitry 330 is coupled along the transmission path 328 between the output of the RF signal source 320 and the electrode 340. In a specific embodiment, the power detection circuitry 330 forms a portion of the RF subsystem 310, and is coupled to the conductor 328-2 between the output of the first matching circuit 334 and the input to the variable impedance matching network 370, in an embodiment. In alternate embodiments, the power detection circuitry 330 may be coupled to the portion 328-1 of the transmission path 328 between the output of the RF signal source 320 and the input to the first matching circuit 334, or to the portion 328-3 of the transmission path 328 between the output of the variable impedance matching network 370 and the first electrode 340.

Wherever it is coupled, power detection circuitry 330 is configured to monitor, measure, or otherwise detect the power of the reflected signals traveling along the transmission path 328 between the RF signal source 320 and electrode 340 (i.e., reflected RF signals traveling in a direction from electrode 340 toward RF signal source 320). In some embodiments, power detection circuitry 330 also is configured to detect the power of the forward signals traveling along the transmission path 328 between the RF signal source 320 and the electrode 340 (i.e., forward RF signals traveling in a direction from RF signal source 320 toward electrode 340). Over connection 332, power detection circuitry 330 supplies signals to system controller 312 conveying the magnitudes of the reflected signal power (and the forward signal power, in some embodiments) to system controller 312. In embodiments in which both the forward and reflected signal power magnitudes are conveyed, system controller 312 may calculate a reflected-to-forward signal power ratio, or the S11 parameter. As will be described in more detail below, when the reflected signal power magnitude exceeds a reflected signal power threshold, or when the reflected-to-forward signal power ratio exceeds an S11 parameter threshold, this indicates that the system 300 is not adequately matched to the cavity input impedance, and that energy absorption by the load 364 within the cavity 360 may be sub-optimal. In such a situation, system controller 312 orchestrates a process of altering the state of the variable matching network 370 to drive the reflected signal power or the S11 parameter toward or below a desired level (e.g., below the reflected signal power threshold and/or the reflected-to-forward signal power ratio threshold), thus re-establishing an acceptable match and facilitating more optimal energy absorption by the load 364.

More specifically, the system controller 312 may provide control signals over control path 316 to the variable matching circuit 970, which cause the variable matching circuit 370 to vary inductive, capacitive, and/or resistive values of one or more components within the circuit, thus adjusting the impedance transformation provided by the circuit 370. Adjustment of the configuration of the variable matching circuit 370 desirably decreases the magnitude of reflected signal power, which corresponds to decreasing the magnitude of the S11 parameter and increasing the power absorbed by the load 364.

As discussed above, the variable impedance matching network 370 is used to match the input impedance of the defrosting cavity 360 plus load 364 to maximize, to the extent possible, the RF power transfer into the load 364. The initial impedance of the defrosting cavity 360 and the load 364 may not be known with accuracy at the beginning of a defrosting operation. Further, the impedance of the load 364 changes during a defrosting operation as the load 364 warms up. According to an embodiment, the system controller 312 may provide control signals to the variable impedance matching network 370, which cause modifications to the state of the variable impedance matching network 370. This enables the system controller 312 to establish an initial state of the variable impedance matching network 370 at the beginning of the defrosting operation that has a relatively low reflected to forward power ratio, and thus a relatively high absorption of the RF power by the load 364. In addition, this enables the system controller 312 to modify the state of the variable impedance matching network 370 so that an adequate match may be maintained throughout the defrosting operation, despite changes in the impedance of the load 364.

The variable matching network 370 may have any of a variety of configurations. For example, the network 370 may include any one or more circuits selected from an inductance/capacitance (LC) network, an inductance-only network, a capacitance-only network, or a combination of bandpass, high-pass and low-pass circuits, in various embodiments. In an embodiment, the variable matching network 370 includes a single-ended network (e.g., network 600, FIG. 6). The inductance, capacitance, and/or resistance values provided by the variable matching network 370, which in turn affect the impedance transformation provided by the network 370, are established using control signals from the system controller 312, as will be described in more detail later. In any event, by changing the state of the variable matching network 370 over the course of a defrosting operation to dynamically match the ever-changing impedance of the cavity 360 plus the load 364 within the cavity 360, the system efficiency may be maintained at a high level throughout the defrosting operation.

Figure 4:
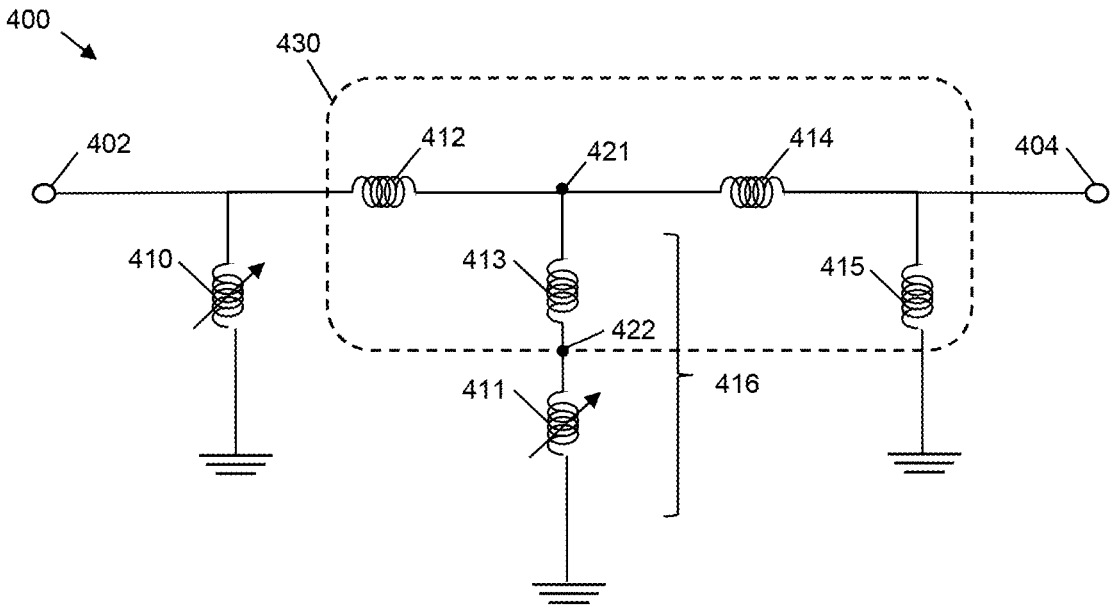
FIG. 4 is a schematic diagram of a single-ended variable inductance matching network, in accordance with an example embodiment.
Figure 5:
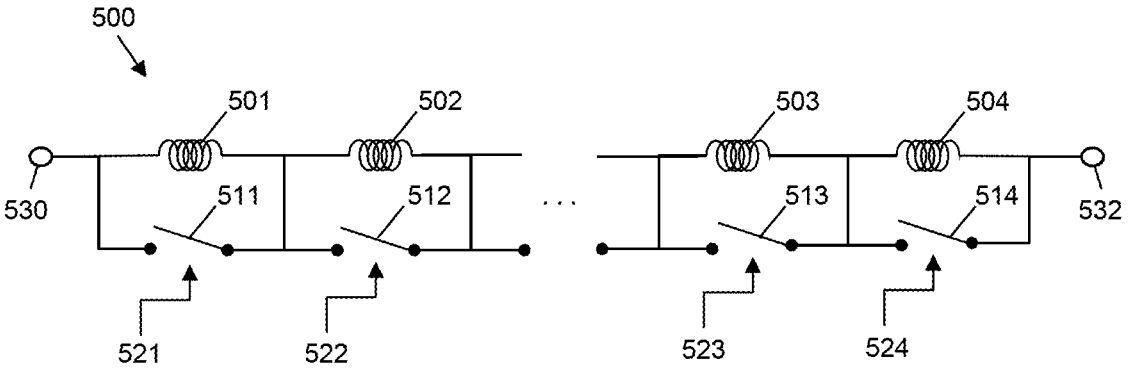
FIG. 5 is a schematic diagram of a single-ended variable inductance network, in accordance with an example embodiment.

The variable matching network 370 may have any of a wide variety of circuit configurations, and non-limiting examples of such configurations are shown in FIGS. 4 and 5. According to an embodiment, the variable impedance matching network 370 may include a single-ended network of passive components, and more specifically a network of fixed-value inductors (e.g., lumped inductive components) and variable inductors (or variable inductance networks). As used herein, the term "inductor" means a discrete inductor or a set of inductive components that are electrically coupled together without intervening components of other types (e.g., resistors or capacitors).

FIG. 4 is a schematic diagram of a single-ended variable impedance matching network 400 (e.g., variable impedance matching network 370, FIG. 3), in accordance with an example embodiment. As will be explained in more detail below, the variable impedance matching network 370 essentially has two portions: one portion to match the RF signal source (or the final stage power amplifier); and another portion to match the cavity plus load.

Variable impedance matching network 400 includes an input node 402, an output node 404, first and second variable inductance networks 410, 411, and a plurality of fixed-value inductors 412-415, according to an embodiment. When incorporated into a defrosting system (e.g., system 300, FIG. 3), the input node 402 is electrically coupled to an output of the RF signal source (e.g., RF signal source 320, FIG. 3), and the output node 404 is electrically coupled to an electrode (e.g., first electrode 340, FIG. 3) within the defrosting cavity (e.g., defrosting cavity 360, FIG. 3).

Between the input and output nodes 402, 404, the variable impedance matching network 400 includes first and second, series coupled lumped inductors 412, 414, in an embodiment. The first and second lumped inductors 412, 414 are relatively large in both size and inductance value, in an embodiment, as they may be designed for relatively low frequency (e.g., about 4.66 MHz to about 4.68 MHz) and high power (e.g., about 50 watts (W) to about 500 W) operation. For example, inductors 412, 414 may have values in a range of about 200 nanohenries (nH) to about 600 nH, although their values may be lower and/or higher, in other embodiments.

The first variable inductance network 410 is a first shunt inductive network that is coupled between the input node 402 and a ground reference terminal (e.g., the grounded containment structure 366, FIG. 3). According to an embodiment, the first variable inductance network 410 is configurable to match the impedance of the RF signal source (e.g., RF signal source 320, FIG. 3) as modified by the first matching circuit (e.g., circuit 334, FIG. 3), or more particularly to match the impedance of the final stage power amplifier (e.g., amplifier 325, FIG. 3) as modified by the first matching circuit 334 (e.g., circuit 334, FIG. 3). Accordingly, the first variable inductance network 410 may be referred to as the "power amplifier matching portion" of the variable impedance matching network 400. According to an embodiment, and as will be described in more detail in conjunction with FIG. 5, the first variable inductance network 410 includes a network of inductive components that may be selectively coupled together to provide inductances in a range of about 10 nH to about 400 nH, although the range may extend to lower or higher inductance values, as well.

In contrast, the "cavity matching portion" of the variable impedance matching network 400 is provided by a second shunt inductive network 416 that is coupled between a node 422 between the first and second lumped inductors 412, 414 and the ground reference terminal. According to an embodiment, the second shunt inductive network 416 includes a third lumped inductor 413 and a second variable inductance network 411 coupled in series, with an intermediate node 422 between the third lumped inductor 413 and the second variable inductance network 411. Because the state of the second variable inductance network 411 may be changed to provide multiple inductance values, the second shunt inductive network 416 is configurable to optimally match the impedance of the cavity plus load (e.g., cavity 360 plus load 364, FIG. 3). For example, inductor 413 may have a value in a range of about 400 nH to about 800 nH, although its value may be lower and/or higher, in other embodiments. According to an embodiment, and as will be described in more detail in conjunction with FIG. 5, the second variable inductance network 411 includes a network of inductive components that may be selectively coupled together to provide inductances in a range of about 50 nH to about 800 nH, although the range may extend to lower or higher inductance values, as well.

Finally, the variable impedance matching network 400 includes a fourth lumped inductor 415 coupled between the output node 404 and the ground reference terminal. For example, inductor 415 may have a value in a range of about 400 nH to about 800 nH, although its value may be lower and/or higher, in other embodiments.

As will be described in more detail in conjunction with FIGS. 7 and 8, the set 430 of lumped inductors 412-415 may be physically located within the cavity (e.g., cavity 360, FIG. 3), or at least within the confines of the containment structure (e.g., containment structure 366, FIG. 3). This enables the radiation produced by the lumped inductors 412-415 to be safely contained within the system, rather than being radiated out into the surrounding environment. In contrast, the variable inductance networks 410, 411 may or may not be contained within the cavity or the containment structure, in various embodiments.

According to an embodiment, the variable impedance matching network 400 embodiment of FIG. 4 includes "only inductors" to provide a match for the input impedance of the defrosting cavity 360 plus load 364. Thus, the network 400 may be considered an "inductor-only" matching network. As used herein, the phrases "only inductors" or "inductor-only" when describing the components of the variable impedance matching network means that the network does not include discrete resistors with significant resistance values or discrete capacitors with significant capacitance values. In some cases, conductive transmission lines between components of the matching network may have minimal resistances, and/or minimal parasitic capacitances may be present within the network. Such minimal resistances and/or minimal parasitic capacitances are not to be construed as converting embodiments of the "inductor-only" network into a matching network that also includes resistors and/or capacitors. Those of skill in the art would understand, however, that other embodiments of variable impedance matching networks may include differently configured inductor-only matching networks, and matching networks that include combinations of discrete inductors, discrete capacitors, and/or discrete resistors. As will be described in more detail in conjunction with FIG. 6, an "inductor-only" matching network alternatively may be defined as a matching network that enables impedance matching of a capacitive load using solely or primarily inductive components.

FIG. 5 is a schematic diagram of a variable inductance network 500 that may be incorporated into a variable impedance matching network (e.g., as variable inductance networks 410 and/or 411, FIG. 4), in accordance with an example embodiment. Network 500 includes an input node 530, an output node 532, and a plurality, N, of discrete inductors 501-504 coupled in series with each other between the input and output nodes 530, 523, where N may be an integer between 2 and 10, or more. In addition, network 500 includes a plurality, N, of bypass switches 511-514, where each switch 511-514 is coupled in parallel across the terminals of one of the inductors 501-504. Switches 511-514 may be implemented as transistors, mechanical relays or mechanical switches, for example. The electrically conductive state of each switch 511-514 (i.e., open or closed) is controlled through control signals 521-524 from the system controller (e.g., system controller 312, FIG. 3).

For each parallel inductor/switch combination, substantially all current flows through the inductor when its corresponding switch is in an open or non-conductive state, and substantially all current flows through the switch when the switch is in a closed or conductive state. For example, when all switches 511-514 are open, as illustrated in FIG. 5, substantially all current flowing between input and output nodes 530, 532 flows through the series of inductors 501-504. This configuration represents the maximum inductance state of the network 500 (i.e., the state of network 500 in which a maximum inductance value is present between input and output nodes 530, 532). Conversely, when all switches 511-514 are closed, substantially all current flowing between input and output nodes 530, 532 bypasses the inductors 501-504 and flows instead through the switches 511-514 and the conductive interconnections between nodes 530, 532 and switches 511-514. This configuration represents the minimum inductance state of the network 500 (i.e., the state of network 500 in which a minimum inductance value is present between input and output nodes 530, 532). Ideally, the minimum inductance value would be near zero inductance. However, in practice a "trace" inductance is present in the minimum inductance state due to the cumulative inductances of the switches 511-514 and the conductive interconnections between nodes 530, 532 and the switches 511-514. For example, in the minimum inductance state, the trace inductance for the variable inductance network 500 may be in a range of about 10 nH to about 50 nH, although the trace inductance may be smaller or larger, as well. Larger, smaller, or substantially similar trace inductances also may be inherent in each of the other network states, as well, where the trace inductance for any given network state is a summation of the inductances of the sequence of conductors and switches through which the current primarily is carried through the network 500.

Starting from the maximum inductance state in which all switches 511-514 are open, the system controller may provide control signals 521-524 that result in the closure of any combination of switches 511-514 in order to reduce the inductance of the network 500 by bypassing corresponding combinations of inductors 501-504. In one embodiment, each inductor 501-504 has substantially the same inductance value, referred to herein as a normalized value of I. For example, each inductor 501-504 may have a value in a range of about 10 nH to about 200 nH, or some other value. In such an embodiment, the maximum inductance value for the network 500 (i.e., when all switches 511-514 are in an open state) would be about N×I, plus any trace inductance that may be present in the network 500 when it is in the maximum inductance state. When any n switches are in a closed state, the inductance value for the network 500 would be about (N−n)×I (plus trace inductance). In such an embodiment, the state of the network 500 may be configured to have any of N+1 values of inductance.

In an alternate embodiment, the inductors 501-504 may have different values from each other. For example, moving from the input node 530 toward the output node 532, the first inductor 501 may have a normalized inductance value of I, and each subsequent inductor 502-504 in the series may have a larger or smaller inductance value. For example, each subsequent inductor 502-504 may have an inductance value that is a multiple (e.g., about twice) the inductance value of the nearest downstream inductor 501-503, although the difference may not necessarily be an integer multiple. In such an embodiment, the state of the network 500 may be configured to have any of $2^N$ values of inductance. For example, when N=4 and each inductor 501-504 has a different value, the network 500 may be configured to have any of 16 values of inductance. For example, but not by way of limitation, assuming that inductor 501 has a value of I, inductor 502 has a value of 2×I, inductor 503 has a value of 4×I, and inductor 504 has a value of 8×I, Table 1, below indicates the total inductance value for all 16 possible states of the network 500 (not accounting for trace inductances):

TABLE 1

Total inductance values for all possible variable inductance network states

| Network state | Switch 511 state (501 value = I) | Switch 512 state (502 value = 2 × I) | Switch 513 state (503 value = 4 × I) | Switch 514 state (504 value = 8 × I) | Total network inductance (w/o trace inductance) |
|---|---|---|---|---|---|
| 0 | closed | closed | closed | closed | 0 |
| 1 | open | closed | closed | closed | I |
| 2 | closed | open | closed | closed | 2 × I |
| 3 | open | open | closed | closed | 3 × I |
| 4 | closed | closed | open | closed | 4 × I |
| 5 | open | closed | open | closed | 5 × I |
| 6 | closed | open | open | closed | 6 × I |
| 7 | open | open | open | closed | 7 × I |
| 8 | closed | closed | closed | open | 8 × I |
| 9 | open | closed | closed | open | 9 × I |
| 10 | closed | open | closed | open | 10 × I |
| 11 | open | open | closed | open | 11 × I |
| 12 | closed | closed | open | open | 12 × I |
| 13 | open | closed | open | open | 13 × I |
| 14 | closed | open | open | open | 14 × I |
| 15 | open | open | open | open | 15 × I |

Referring again to FIG. 4, an embodiment of variable inductance network 410 may be implemented in the form of variable inductance network 500 with the above-described example characteristics (i.e., N=4 and each successive inductor is about twice the inductance of the preceding inductor). Assuming that the trace inductance in the minimum inductance state is about 10 nH, and the range of inductance values achievable by network 410 is about 10 nH (trace inductance) to about 400 nH, the values of inductors 501-504 may be, for example, about 30 nH, about 50 nH, about 100 nH, and about 200 nH, respectively. Similarly, if an embodiment of variable inductance network 411 is implemented in the same manner, and assuming that the trace inductance is about 50 nH and the range of inductance values achievable by network 411 is about 50 nH (trace inductance) to about 800 nH, the values of inductors 501-504 may be, for example, about 50 nH, about 100 nH, about 200 nH, and about 400 nH, respectively. Of course, more or fewer than four inductors 501-504 may be included in either variable inductance network 410, 411, and the inductors within each network 410, 411 may have different values.

Although the above example embodiment specifies that the number of switched inductances in the network 500 equals four, and that each inductor 501-504 has a value that is some multiple of a value of I, alternate embodiments of variable inductance networks may have more or fewer than four inductors, different relative values for the inductors, a different number of possible network states, and/or a different configuration of inductors (e.g., differently connected sets of parallel and/or series coupled inductors). Either way, by providing a variable inductance network in an impedance matching network of a defrosting system, the system may be better able to match the ever-changing cavity input impedance that is present during a defrosting operation.

Figure 6:
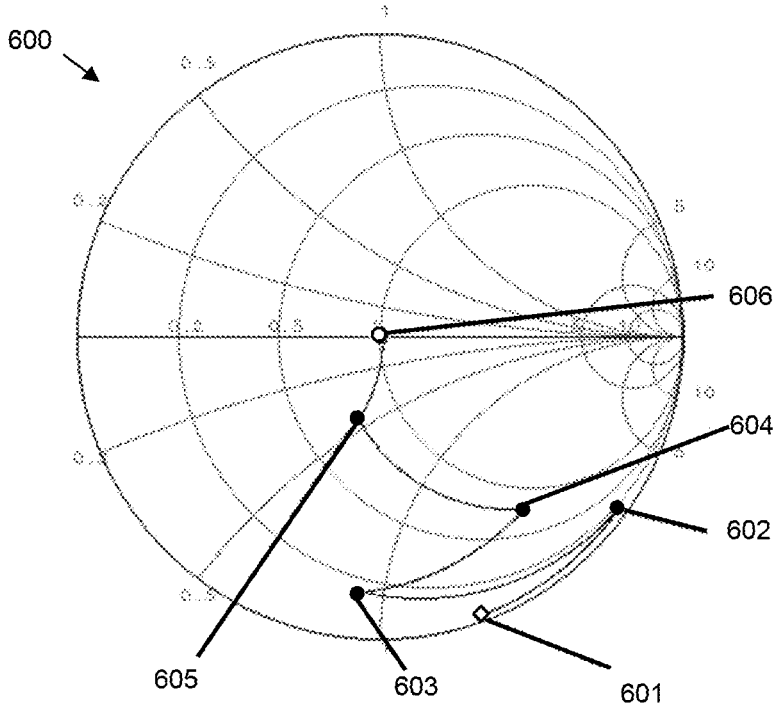
FIG. 6 is an example of a Smith chart depicting how a plurality of inductances in an embodiment of a variable impedance matching network may match the input cavity impedance to an RF signal source.

FIG. 6 is an example of a Smith chart 600 depicting how the plurality of inductances in an embodiment of a variable impedance matching network (e.g., network 370, 400, FIGS.

3, 4) may match the input cavity impedance to the RF signal source. The example Smith chart 600 assumes that the system is a 50 Ohm system, and that the output of the RF signal source is 50 Ohms. Those of skill in the art would understand, based on the description herein, how the Smith chart could be modified for a system and/or RF signal source with different characteristic impedances.

In Smith chart 600, point 601 corresponds to the point at which the load (e.g., the cavity 360 plus load 364, FIG. 3) would locate (e.g., at the beginning of a defrosting operation) absent the matching provided by the variable impedance matching network (e.g., network 370, 400, FIGS. 3, 4). As indicated by the position of the load point 601 in the lower right quadrant of the Smith chart 600, the load is a capacitive load. According to an embodiment, the shunt and series inductances of the variable impedance matching network sequentially move the substantially-capacitive load impedance toward an optimal matching point 606 (e.g., 50 Ohms) at which RF energy transfer to the load may occur with minimal losses. More specifically, and referring also to FIG. 4, shunt inductance 415 moves the impedance to point 602, series inductance 414 moves the impedance to point 603, shunt inductance 416 moves the impedance to point 604, series inductance 412 moves the impedance to point 605, and shunt inductance 410 moves the impedance to the optimal matching point 606.

It should be noted that the combination of impedance transformations provided by embodiments of the variable impedance matching network keep the impedance at any point within or very close to the lower right quadrant of the Smith chart 600. As this quadrant of the Smith chart 600 is characterized by relatively high impedances and relatively low currents, the impedance transformation is achieved without exposing components of the circuit to relatively high and potentially damaging currents. Accordingly, an alternate definition of an "inductor-only" matching network, as used herein, may be a matching network that enables impedance matching of a capacitive load using solely or primarily inductive components, where the impedance matching network performs the transformation substantially within the lower right quadrant of the Smith chart.

As discussed previously, the impedance of the load changes during the defrosting operation. Accordingly, point 601 correspondingly moves during the defrosting operation. Movement of load point 601 is compensated for, according to the previously-described embodiments, by varying the impedance of the first and second shunt inductances 410, 411 so that the final match provided by the variable impedance matching network still may arrive at or near the optimal matching point 606. Although a specific variable impedance matching network has been illustrated and described herein, those of skill in the art would understand, based on the description herein, that differently-configured variable impedance matching networks may achieve the same or similar results to those conveyed by Smith chart 600. For example, alternative embodiments of a variable impedance matching network may have more or fewer shunt and/or series inductances, and or different ones of the inductances may be configured as variable inductance networks (e.g., including one or more of the series inductances). Accordingly, although a particular variable inductance matching network has been illustrated and described herein, the inventive subject matter is not limited to the illustrated and described embodiment.

A particular physical configuration of a defrosting system will now be described in conjunction with FIGS. 7 and 8. More particularly, FIG. 7 is a cross-sectional, side view of a defrosting system 700, in accordance with an example embodiment, and FIG. 8 is a perspective view of a portion of defrosting system 700. The defrosting system 700 generally includes a defrosting cavity 774, a user interface (not shown), a system controller 730, an RF signal source 720, power supply and bias circuitry (not shown), power detection circuitry 780, a variable impedance matching network 760, a first electrode 770, and a second electrode 772, in an embodiment. In addition, in some embodiments, defrosting system 700 may include weight sensor(s) 790, temperature sensor(s), and/or IR sensor(s) 792.

The defrosting system 700 is contained within a containment structure 750, in an embodiment. According to an embodiment, the containment structure 750 may define three interior areas: the defrosting cavity 774, a fixed inductor area 776, and a circuit housing area 778. The containment structure 750 includes bottom, top, and side walls. Portions of the interior surfaces of some of the walls of the containment structure 750 may define the defrosting cavity 774. The defrosting cavity 774 includes a capacitive defrosting arrangement with first and second parallel plate electrodes 770, 772 that are separated by an air cavity within which a load 764 to be defrosted may be placed. For example, the first electrode 770 may be positioned above the air cavity, and a second electrode 772 may be provided by a conductive portion of the containment structure 750 (e.g., a portion of the bottom wall of the containment structure 750). Alternatively, the second electrode 772 may be formed from a conductive plate that is distinct from the containment structure 750. According to an embodiment, non-electrically conductive support structure(s) 754 may be employed to suspend the first electrode 770 above the air cavity, to electrically isolate the first electrode 770 from the containment structure 750, and to hold the first electrode 770 in a fixed physical orientation with respect to the air cavity.

According to an embodiment, the containment structure 750 is at least partially formed from conductive material, and the conductive portion(s) of the containment structure may be grounded to provide a ground reference for various electrical components of the system. Alternatively, at least the portion of the containment structure 750 that corresponds to the second electrode 772 may be formed from conductive material and grounded. To avoid direct contact between the load 764 and the second electrode 772, a non-conductive barrier 756 may be positioned over the second electrode 772.

When included in the system 700, the weight sensor(s) 790 are positioned under the load 764. The weight sensor(s) 790 are configured to provide an estimate of the weight of the load 764 to the system controller 730. The temperature sensor(s) and/or IR sensor(s) 792 may be positioned in locations that enable the temperature of the load 764 to be sensed both before, during, and after a defrosting operation. According to an embodiment, the temperature sensor(s) and/or IR sensor(s) 792 are configured to provide load temperature estimates to the system controller 730.

Some or all of the various components of the system controller 730, the RF signal source 720, the power supply and bias circuitry (not shown), the power detection circuitry 780, and portions 710, 711 of the variable impedance matching network 760, may be coupled to a common substrate 752 within the circuit housing area 778 of the containment structure 750, in an embodiment. For example, some of all of the above-listed components may be included in an RF module (e.g., RF module 1300, FIG. 13) and a variable impedance matching circuit module (e.g., a variation of module 1200, FIG. 12), which are housed within the circuit housing area 778 of the containment structure 750. According to an embodiment, the system controller 730 is coupled to the user interface, RF signal source 720, variable impedance matching network 760, and power detection circuitry 780 through various conductive interconnects on or within the common substrate 752. In addition, the power detection circuitry 780 is coupled along the transmission path 748 between the output of the RF signal source 720 and the input 702 to the variable impedance matching network 760, in an embodiment. For example, the substrate 752 may include a microwave or RF laminate, a polytetrafluoroethylene (PTFE) substrate, a printed circuit board (PCB) material substrate (e.g., FR-4), an alumina substrate, a ceramic tile, or another type of substrate. In various alternate embodiments, various ones of the components may be coupled to different substrates with electrical interconnections between the substrates and components. In still other alternate embodiments, some or all of the components may be coupled to a cavity wall, rather than being coupled to a distinct substrate.

The first electrode 770 is electrically coupled to the RF signal source 720 through a variable impedance matching network 760 and a transmission path 748, in an embodiment. As discussed previously, the variable impedance matching network 760 includes variable inductance networks 710, 711 (e.g., networks 410, 411, FIG. 4) and a plurality of fixed-value lumped inductors 712-715 (e.g., inductors 412-415, FIG. 4). In an embodiment, the variable inductance networks 710, 711 are coupled to the common substrate 752 and located within the circuit housing area 778. In contrast, the fixed-value lumped inductors 712-715 are positioned within the fixed inductor area 776 of the containment structure 750 (e.g., between the common substrate 752 and the first electrode 770). Conductive structures (e.g., conductive vias or other structures) may provide for electrical communication between the circuitry within the circuit housing area 778 and the lumped inductors 712-715 within the fixed inductor area 776.

Figure 7:
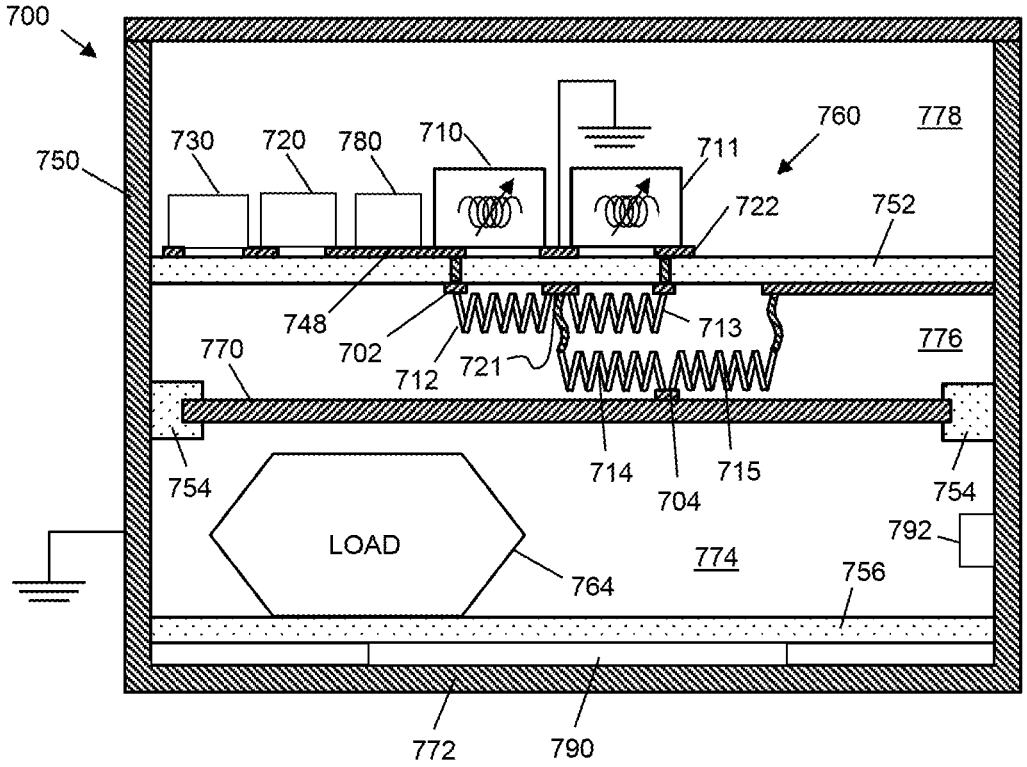
FIG. 7 is a cross-sectional, side view of a defrosting system, in accordance with an example embodiment.
Figure 8:
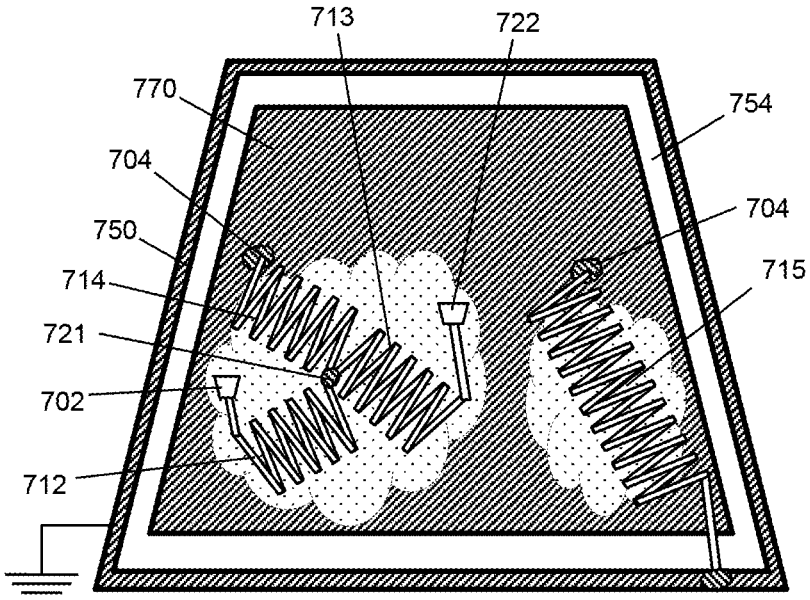
FIG. 8 is a perspective view of a portion of a defrosting system, in accordance with an example embodiment.

For enhanced understanding of the system 700, the nodes and components of the variable impedance matching network 760 depicted in FIGS. 7 and 8 will now be correlated with nodes and components of the variable impedance matching network 400 depicted in FIG. 4. More specifically, the variable impedance matching network 760 includes an input node 702 (e.g., input node 402, FIG. 4), an output node 704 (e.g., output node 404, FIG. 4), first and second variable inductance networks 710, 711 (e.g., variable inductance networks 410, 411, FIG. 4), and a plurality of fixed-value inductors 712-715 (e.g., inductors 412-415, FIG. 4), according to an embodiment. The input node 702 is electrically coupled to an output of the RF signal source 720 through various conductive structures (e.g., conductive vias and traces), and the output node 704 is electrically coupled to the first electrode 770.

Between the input and output nodes 702, 704 (e.g., input and output nodes 402, 404, FIG. 4), the variable impedance matching network 700 includes four lumped inductors 712-715 (e.g., inductors 412-415, FIG. 4), in an embodiment, which are positioned within the fixed inductor area 776. An enhanced understanding of an embodiment of a physical configuration of the lumped inductors 712-715 within the fixed inductor area 776 may be achieved by referring to both FIG. 7 and to FIG. 8 simultaneously, where FIG. 8 depicts a top perspective view of the fixed inductor area 776. In FIG. 8, the irregularly shaped, shaded areas underlying inductors 712-715 represents suspension of the inductors 712-715 in space over the first electrode 770. In other words, the shaded areas indicate where the inductors 712-715 are electrically insulated from the first electrode 770 by air. Rather than relying on an air dielectric, non-electrically conductive spacers may be included in these areas.

In an embodiment, the first lumped inductor 712 has a first terminal that is electrically coupled to the input node 702 (and thus to the output of RF signal source 720), and a second terminal that is electrically coupled to a first intermediate node 721 (e.g., node 421, FIG. 4). The second lumped inductor 713 has a first terminal that is electrically coupled to the first intermediate node 721, and a second terminal that is electrically coupled to a second intermediate node 722 (e.g., node 422, FIG. 4). The third lumped inductor 714 has a first terminal that is electrically coupled to the first intermediate node 721, and a second terminal that is electrically coupled to the output node 704 (and thus to the first electrode 770). The fourth lumped inductor 715 has a first terminal that is electrically coupled to the output node 704 (and thus to the first electrode 770), and a second terminal that is electrically coupled to a ground reference node (e.g., to the grounded containment structure 750 through one or more conductive interconnects).

The first variable inductance network 710 (e.g., network 410, FIG. 4) is electrically coupled between the input node 702 and a ground reference terminal (e.g., the grounded containment structure 750). Finally, the second variable inductance network 711 (e.g., network 411, FIG. 4) is electrically coupled between the second intermediate node 722 and the ground reference terminal.

The description associated with FIGS. 3-8 discuss, in detail, an "unbalanced" defrosting apparatus, in which an RF signal is applied to one electrode (e.g., electrode 340, FIG. 3), and the other "electrode" (e.g., the containment structure 366, FIG. 3) is grounded. As mentioned above, an alternate embodiment of a defrosting apparatus comprises a "balanced" defrosting apparatus. In such an apparatus, balanced RF signals are provided to both electrodes.

For example, FIG. 9 is a simplified block diagram of a balanced defrosting system 900 (e.g., defrosting system 100, 210, 220, FIGS. 1, 2), in accordance with an example embodiment. Defrosting system 900 includes RF subsystem 910, defrosting cavity 960, user interface 980, system controller 912, RF signal source 920, power supply and bias circuitry 926, variable impedance matching network 970, two electrodes 940, 950, and power detection circuitry 930, in an embodiment. In addition, in other embodiments, defrosting system 900 may include temperature sensor(s), infrared (IR) sensor(s), and/or weight sensor(s) 990, although some or all of these sensor components may be excluded. It should be understood that FIG. 9 is a simplified representation of a defrosting system 900 for purposes of explanation and ease of description, and that practical embodiments may include other devices and components to provide additional functions and features, and/or the defrosting system 900 may be part of a larger electrical system.

User interface 980 may correspond to a control panel (e.g., control panel 120, 214, 224, FIGS. 1, 2), for example, which enables a user to provide inputs to the system regarding parameters for a defrosting operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting operation (e.g., a countdown timer, visible indicia indicating progress or completion of the defrosting operation, and/or audible tones indicating completion of the defrosting operation) and other information.

The RF subsystem 910 includes a system controller 912, an RF signal source 920, a first impedance matching circuit 934 (herein "first matching circuit"), power supply and bias circuitry 926, and power detection circuitry 930, in an embodiment. System controller 912 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, system controller 912 is operatively and communicatively coupled to user interface 980, RF signal source 920, power supply and bias circuitry 926, power detection circuitry 930 (or 930' or 930"), variable matching subsystem 970, sensor (s) 990 (if included), and pump 992 (if included). System controller 912 is configured to receive signals indicating user inputs received via user interface 980, to receive signals indicating RF signal reflected power (and possibly RF signal forward power) from power detection circuitry 930 (or 930' or 930"), and to receive sensor signals from sensor(s) 990. Responsive to the received signals and measurements, and as will be described in more detail later, system controller 912 provides control signals to the power supply and bias circuitry 926 and/or to the RF signal generator 922 of the RF signal source 920. In addition, system controller 912 provides control signals to the variable matching subsystem 970 (over path 916), which cause the subsystem 970 to change the state or configuration of a variable impedance matching circuit 972 of the subsystem 970 (herein "variable matching circuit").

Defrosting cavity 960 includes a capacitive defrosting arrangement with first and second parallel plate electrodes 940, 950 that are separated by an air cavity within which a load 964 to be defrosted may be placed. Within a containment structure 966, first and second electrodes 940, 950 (e.g., electrodes 140, 150, FIG. 1) are positioned in a fixed physical relationship with respect to each other on either side of an interior defrosting cavity 960 (e.g., interior cavity 260, FIG. 2). According to an embodiment, a distance 952 between the electrodes 940, 950 renders the cavity 960 a sub-resonant cavity, in an embodiment.

The first and second electrodes 940, 950 are separated across the cavity 960 by a distance 952. In various embodiments, the distance 952 is in a range of about 0.10 meters to about 1.0 meter, although the distance may be smaller or larger, as well. According to an embodiment, distance 952 is less than one wavelength of the RF signal produced by the RF subsystem 910. In other words, as mentioned above, the cavity 960 is a sub-resonant cavity. In some embodiments, the distance 952 is less than about half of one wavelength of the RF signal. In other embodiments, the distance 952 is less than about one quarter of one wavelength of the RF signal. In still other embodiments, the distance 952 is less than about one eighth of one wavelength of the RF signal. In still other embodiments, the distance 952 is less than about one 50th of one wavelength of the RF signal. In still other embodiments, the distance 952 is less than about one 100th of one wavelength of the RF signal.

In general, a system 900 designed for lower operational frequencies (e.g., frequencies between 10 MHz and 100 MHz) may be designed to have a distance 952 that is a smaller fraction of one wavelength. For example, when system 900 is designed to produce an RF signal with an operational frequency of about 10 MHz (corresponding to a wavelength of about 30 meters), and distance 952 is selected to be about 0.5 meters, the distance 952 is about one 60th of one wavelength of the RF signal. Conversely, when system 900 is designed for an operational frequency of about 300 MHz (corresponding to a wavelength of about 1 meter), and distance 952 is selected to be about 0.5 meters, the distance 952 is about one half of one wavelength of the RF signal.

With the operational frequency and the distance 952 between electrodes 940, 950 being selected to define a sub-resonant interior cavity 960, the first and second electrodes 940, 950 are capacitively coupled. More specifically, the first electrode 940 may be analogized to a first plate of a capacitor, the second electrode 950 may be analogized to a second plate of a capacitor, and the load 964, barrier 962, and air within the cavity 960 may be analogized to a capacitor dielectric. Accordingly, the first electrode 940 alternatively may be referred to herein as an "anode," and the second electrode 950 may alternatively be referred to herein as a "cathode."

Essentially, the voltage across the first and second electrodes 940, 950 heats the load 964 within the cavity 960. According to various embodiments, the RF subsystem 910 is configured to generate the RF signal to produce voltages across the electrodes 940, 950 in a range of about 90 volts to about 3000 volts, in one embodiment, or in a range of about 3000 volts to about 10,000 volts, in another embodiment, although the system may be configured to produce lower or higher voltages across electrodes 940, 950, as well.

An output of the RF subsystem 910, and more particularly an output of RF signal source 920, is electrically coupled to the variable matching subsystem 970 through a conductive transmission path, which includes a plurality of conductors 928-1, 928-2, 928-3, 928-4, and 928-5 connected in series, and referred to collectively as transmission path 928. According to an embodiment, the conductive transmission path 928 includes an "unbalanced" portion and a "balanced" portion, where the "unbalanced" portion is configured to carry an unbalanced RF signal (i.e., a single RF signal referenced against ground), and the "balanced" portion is configured to carry a balanced RF signal (i.e., two signals referenced against each other). The "unbalanced" portion of the transmission path 928 may include unbalanced first and second conductors 928-1, 928-2 within the RF subsystem 910, one or more connectors 936, 938 (each having male and female connector portions), and an unbalanced third conductor 928-3 electrically coupled between the connectors 936, 938. According to an embodiment, the third conductor 928-3 comprises a coaxial cable, although the electrical length may be shorter or longer, as well. In an alternate embodiment, the variable matching subsystem 970 may be housed with the RF subsystem 910, and in such an embodiment, the conductive transmission path 928 may exclude the connectors 936, 938 and the third conductor 928-3. Either way, the "balanced" portion of the conductive transmission path 928 includes a balanced fourth conductor 928-4 within the variable matching subsystem 970, and a balanced fifth conductor 928-5 electrically coupled between the variable matching subsystem 970 and electrodes 940, 950, in an embodiment.

As indicated in FIG. 9, the variable matching subsystem 970 houses an apparatus configured to receive, at an input of the apparatus, the unbalanced RF signal from the RF signal source 920 over the unbalanced portion of the transmission path (i.e., the portion that includes unbalanced conductors 928-1, 928-2, and 928-3), to convert the unbalanced RF signal into two balanced RF signals (e.g., two RF signals having a phase difference between 120 and 240 degrees, such as about 180 degrees), and to produce the two balanced RF signals at two outputs of the apparatus. For example, the conversion apparatus may be a balun 974, in an embodiment. The balanced RF signals are conveyed over balanced conductors 928-4 to the variable matching circuit 972 and, ultimately, over balanced conductors 928-5 to the electrodes 940, 950.

In an alternate embodiment, as indicated in a dashed box in the center of FIG. 9, and as will be discussed in more detail below, an alternate RF signal generator 920' may produce balanced RF signals on balanced conductors 928-1', which may be directly coupled to the variable matching circuit 972 (or coupled through various intermediate conductors and connectors). In such an embodiment, the balun 974 may be excluded from the system 900. Either way, as will be described in more detail below, a double-ended variable matching circuit 972 (e.g., variable matching circuit 1000, FIG. 10) is configured to receive the balanced RF signals (e.g., over connections 928-4 or 928-1'), to perform an impedance transformation corresponding to a then-current configuration of the double-ended variable matching circuit 972, and to provide the balanced RF signals to the first and second electrodes 940, 950 over connections 928-5.

According to an embodiment, RF signal source 920 includes an RF signal generator 922 and a power amplifier 924 (e.g., including one or more power amplifier stages). In response to control signals provided by system controller 912 over connection 914, RF signal generator 922 is configured to produce an oscillating electrical signal having a frequency in an ISM (industrial, scientific, and medical) band, although the system could be modified to support operations in other frequency bands, as well. The RF signal generator 922 may be controlled to produce oscillating signals of different power levels and/or different frequencies, in various embodiments. For example, the RF signal generator 922 may produce a signal that oscillates in a range of about 10.0 MHz to about 100 MHz and/or from about 100 MHz to about 3.0 GHz. Some desirable frequencies may be, for example, 13.56 MHz (+/−5 percent), 27.125 MHz (+/−5 percent), 40.68 MHz (+/−5 percent), and 2.45 GHz (+/−5 percent). Alternatively, the frequency of oscillation may be lower or higher than the above-given ranges or values.

The power amplifier 924 is configured to receive the oscillating signal from the RF signal generator 922, and to amplify the signal to produce a significantly higher-power signal at an output of the power amplifier 924. For example, the output signal may have a power level in a range of about 100 watts to about 400 watts or more, although the power level may be lower or higher, as well. The gain applied by the power amplifier 924 may be controlled using gate bias voltages and/or drain bias voltages provided by the power supply and bias circuitry 926 to one or more stages of amplifier 924. More specifically, power supply and bias circuitry 926 provides bias and supply voltages to the inputs and/or outputs (e.g., gates and/or drains) of each RF amplifier stage in accordance with control signals received from system controller 912.

The power amplifier may include one or more amplification stages. In an embodiment, each stage of amplifier 924 is implemented as a power transistor, such as a FET, having an input terminal (e.g., a gate or control terminal) and two current carrying terminals (e.g., source and drain terminals). Impedance matching circuits (not illustrated) may be coupled to the input (e.g., gate) and/or output (e.g., drain terminal) of some or all of the amplifier stages, in various embodiments. In an embodiment, each transistor of the amplifier stages includes an LDMOS FET. However, it should be noted that the transistors are not intended to be limited to any particular semiconductor technology, and in other embodiments, each transistor may be realized as a GaN transistor, another type of MOS FET transistor, a BJT, or a transistor utilizing another semiconductor technology.

In FIG. 9, the power amplifier arrangement 924 is depicted to include one amplifier stage coupled in a particular manner to other circuit components. In other embodiments, the power amplifier arrangement 924 may include other amplifier topologies and/or the amplifier arrangement may include two or more amplifier stages (e.g., as shown in the embodiment of amplifier 324/325, FIG. 3). For example, the power amplifier arrangement may include various embodiments of a single-ended amplifier, a double-ended (balanced) amplifier, a push-pull amplifier, a Doherty amplifier, a Switch Mode Power Amplifier (SMPA), or another type of amplifier.

For example, as indicated in the dashed box in the center of FIG. 9, an alternate RF signal generator 920' may include a push-pull or balanced amplifier 924', which is configured to receive, at an input, an unbalanced RF signal from the RF signal generator 922, to amplify the unbalanced RF signal, and to produce two balanced RF signals at two outputs of the amplifier 924', where the two balanced RF signals are thereafter conveyed over conductors 928-1' to the electrodes 940, 950. In such an embodiment, the balun 974 may be excluded from the system 900, and the conductors 928-1' may be directly connected to the variable matching circuit 972 (or connected through multiple coaxial cables and connectors or other multi-conductor structures).

Defrosting cavity 960 and any load 964 (e.g., food, liquids, and so on) positioned in the defrosting cavity 960 present a cumulative load for the electromagnetic energy (or RF power) that is radiated into the interior chamber 962 by the electrodes 940, 950. More specifically, and as described previously, the defrosting cavity 960 and the load 964 present an impedance to the system, referred to herein as a "cavity input impedance." The cavity input impedance changes during a defrosting operation as the temperature of the load 964 increases. The cavity input impedance has a direct effect on the magnitude of reflected signal power along the conductive transmission path 928 between the RF signal source 920 and the electrodes 940, 950. In most cases, it is desirable to maximize the magnitude of transferred signal power into the cavity 960, and/or to minimize the reflected-to-forward signal power ratio along the conductive transmission path 928.

In order to at least partially match the output impedance of the RF signal generator 920 to the chamber input impedance, a first matching circuit 934 is electrically coupled along the transmission path 928, in an embodiment. The first matching circuit 934 is configured to perform an impedance transformation from an impedance of the RF signal source 920 (e.g., less than about 10 ohms) to an intermediate impedance (e.g., 50 ohms, 75 ohms, or some other value). The first matching circuit 934 may have any of a variety of configurations. According to an embodiment, the first matching circuit 934 includes fixed components (i.e., components with non-variable component values), although the first matching circuit 934 may include one or more variable components, in other embodiments. For example, the first matching circuit 934 may include any one or more circuits selected from an inductance/capacitance (LC) network, a series inductance network, a shunt inductance network, or a combination of bandpass, high-pass and low-pass circuits, in various embodiments. Essentially, the first matching circuit 934 is configured to raise the impedance to an intermediate level between the output impedance of the RF signal generator 920 and the cavity input impedance.

According to an embodiment, and as mentioned above, power detection circuitry 930 is coupled along the transmission path 928 between the output of the RF signal source 920 and the electrodes 940, 950. In a specific embodiment, the power detection circuitry 930 forms a portion of the RF subsystem 910, and is coupled to the conductor 928-2 between the RF signal source 920 and connector 936. In alternate embodiments, the power detection circuitry 930 may be coupled to any other portion of the transmission path 928, such as to conductor 928-1, to conductor 928-3, to conductor 928-4 between the RF signal source 920 (or balun 974) and the variable matching circuit 972 (i.e., as indicated with power detection circuitry 930'), or to conductor 928-5 between the variable matching circuit 972 and the electrode (s) 940, 950 (i.e., as indicated with power detection circuitry 930"). For purposes of brevity, the power detection circuitry is referred to herein with reference number 930, although the circuitry may be positioned in other locations, as indicated by reference numbers 930' and 930".

Wherever it is coupled, power detection circuitry 930 is configured to monitor, measure, or otherwise detect the power of the reflected signals traveling along the transmission path 928 between the RF signal source 920 and one or both of the electrode(s) 940, 950 (i.e., reflected RF signals traveling in a direction from electrode(s) 940, 950 toward RF signal source 920). In some embodiments, power detection circuitry 930 also is configured to detect the power of the forward signals traveling along the transmission path 928 between the RF signal source 920 and the electrode(s) 940, 950 (i.e., forward RF signals traveling in a direction from RF signal source 920 toward electrode(s) 940, 950).

Over connection 932, power detection circuitry 930 supplies signals to system controller 912 conveying the measured magnitudes of the reflected signal power, and in some embodiments, also the measured magnitude of the forward signal power. In embodiments in which both the forward and reflected signal power magnitudes are conveyed, system controller 912 may calculate a reflected-to-forward signal power ratio, or the S11 parameter. As will be described in more detail below, when the reflected signal power magnitude exceeds a reflected signal power threshold, or when the reflected-to-forward signal power ratio exceeds an S11 parameter threshold, this indicates that the system 900 is not adequately matched to the cavity input impedance, and that energy absorption by the load 964 within the cavity 960 may be sub-optimal. In such a situation, system controller 912 orchestrates a process of altering the state of the variable matching circuit 972 to drive the reflected signal power or the S11 parameter toward or below a desired level (e.g., below the reflected signal power threshold and/or the reflected-to-forward signal power ratio threshold), thus re-establishing an acceptable match and facilitating more optimal energy absorption by the load 964.

More specifically, the system controller 912 may provide control signals over control path 916 to the variable matching circuit 972, which cause the variable matching circuit 972 to vary inductive, capacitive, and/or resistive values of one or more components within the circuit, thus adjusting the impedance transformation provided by the circuit 972. Adjustment of the configuration of the variable matching circuit 972 desirably decreases the magnitude of reflected signal power, which corresponds to decreasing the magnitude of the S11 parameter and increasing the power absorbed by the load 964.

As discussed above, the variable matching circuit 972 is used to match the input impedance of the defrosting cavity 960 plus load 964 to maximize, to the extent possible, the RF power transfer into the load 964. The initial impedance of the defrosting cavity 960 and the load 964 may not be known with accuracy at the beginning of a defrosting operation. Further, the impedance of the load 964 changes during a defrosting operation as the load 964 warms up. According to an embodiment, the system controller 912 may provide control signals to the variable matching circuit 972, which cause modifications to the state of the variable matching circuit 972. This enables the system controller 912 to establish an initial state of the variable matching circuit 972 at the beginning of the defrosting operation that has a relatively low reflected to forward power ratio, and thus a relatively high absorption of the RF power by the load 964. In addition, this enables the system controller 912 to modify the state of the variable matching circuit 972 so that an adequate match may be maintained throughout the defrosting operation, despite changes in the impedance of the load 964.

The variable matching circuit 972 may have any of a variety of configurations. For example, the circuit 972 may include any one or more circuits selected from an inductance/capacitance (LC) network, an inductance-only network, a capacitance-only network, or a combination of bandpass, high-pass and low-pass circuits, in various embodiments. In an embodiment in which the variable matching circuit 972 is implemented in a balanced portion of the transmission path 928, the variable matching circuit 972 is a double-ended circuit with two inputs and two outputs. In an alternate embodiment in which the variable matching circuit is implemented in an unbalanced portion of the transmission path 928, the variable matching circuit may be a single-ended circuit with a single input and a single output (e.g., similar to matching circuit 400, FIG. 4). According to more specific embodiments, the variable matching circuit 972 includes a variable inductance network (e.g., double-ended network 1000, FIG. 10). The inductance, capacitance, and/or resistance values provided by the variable matching circuit 972, which in turn affect the impedance transformation provided by the circuit 972, are established through control signals from the system controller 912, as will be described in more detail later. In any event, by changing the state of the variable matching circuit 972 over the course of a treatment operation to dynamically match the ever-changing impedance of the cavity 960 plus the load 964 within the cavity 960, the system efficiency may be maintained at a high level throughout the defrosting operation.

Figure 10:
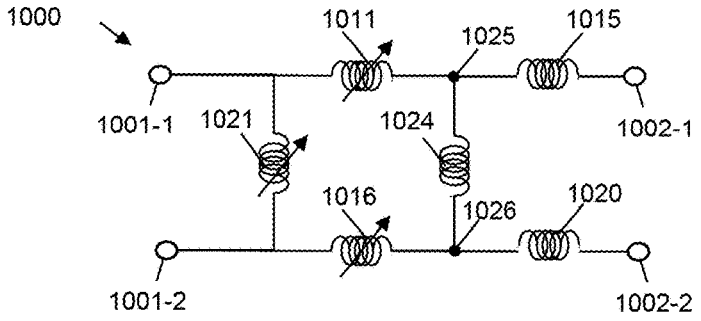
FIG. 10 is a schematic diagram of a double-ended variable impedance matching network, in accordance with another example embodiment.
Figure 11:
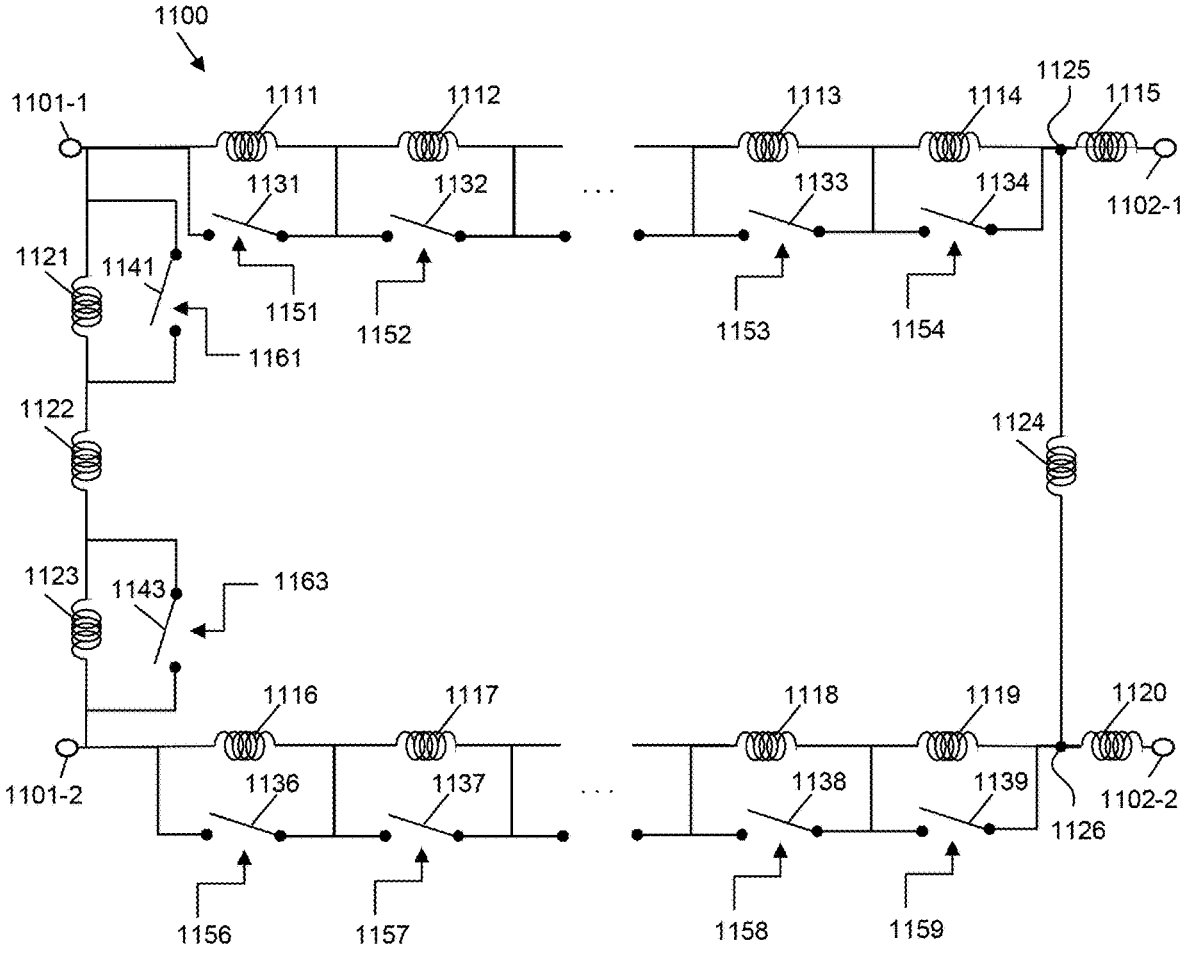
FIG. 11 is a schematic diagram of a double-ended variable impedance network, in accordance with another example embodiment.

The variable matching circuit 972 may have any of a wide variety of circuit configurations, and non-limiting examples of such configurations are shown in FIGS. 10 and 11. For example, FIG. 10 is a schematic diagram of a double-ended variable impedance matching circuit 1000 that may be incorporated into a defrosting system (e.g., system 100, 200, 900, FIGS. 1, 2, 9), in accordance with an example embodiment. According to an embodiment, the variable matching circuit 1000 includes a network of fixed-value and variable passive components.

Circuit 1000 includes a double-ended input 1001-1, 1001-2 (referred to as input 1001), a double-ended output 1002-1, 1002-2 (referred to as output 1002), and a network of passive components connected in a ladder arrangement between the input 1001 and output 1002. For example, when connected into system 900, the first input 1001-1 may be connected to a first conductor of balanced conductor 928-4, and the second input 1001-2 may be connected to a second conductor of balanced conductor 928-4. Similarly, the first output 1002-1 may be connected to a first conductor of balanced conductor 928-5, and the second output 1002-2 may be connected to a second conductor of balanced conductor 928-5.

In the specific embodiment illustrated in FIG. 10, circuit 1000 includes a first variable inductor 1011 and a first fixed inductor 1015 connected in series between input 1001-1 and output 1002-1, a second variable inductor 1016 and a second fixed inductor 1020 connected in series between input 1001-2 and output 1002-2, a third variable inductor 1021 connected between inputs 1001-1 and 1001-2, and a third fixed inductor 1024 connected between nodes 1025 and 1026.

According to an embodiment, the third variable inductor 1021 corresponds to an "RF signal source matching portion", which is configurable to match the impedance of the RF signal source (e.g., RF signal source 920, FIG. 9) as modified by the first matching circuit (e.g., circuit 934, FIG. 9), or more particularly to match the impedance of the final stage power amplifier (e.g., amplifier 924, FIG. 9) as modified by the first matching circuit (e.g., circuit 934, FIG. 9). According to an embodiment, and as will be described in more detail in conjunction with FIG. 11, the third variable inductor 1021 includes a network of inductive components that may be selectively coupled together to provide inductances in a range of about 5 nH to about 200 nH, although the range may extend to lower or higher inductance values, as well.

In contrast, the "cavity matching portion" of the variable impedance matching network 1000 is provided by the first and second variable inductors 1011, 1016, and fixed inductors 1015, 1020, and 1024. Because the states of the first and second variable inductors 1011, 1016 may be changed to provide multiple inductance values, the first and second variable inductors 1011, 1016 are configurable to optimally match the impedance of the cavity plus load (e.g., cavity 960 plus load 964, FIG. 9). For example, inductors 1011, 1016 each may have a value in a range of about 10 nH to about 200 nH, although their values may be lower and/or higher, in other embodiments.

The fixed inductors 1015, 1020, 1024 also may have inductance values in a range of about 50 nH to about 800 nH, although the inductance values may be lower or higher, as well. Inductors 1011, 1015, 1016, 1020, 1021, 1024 may include discrete inductors, distributed inductors (e.g., printed coils), wirebonds, transmission lines, and/or other inductive components, in various embodiments. In an embodiment, variable inductors 1011 and 1016 are operated in a paired manner, meaning that their inductance values during operation are controlled to be equal to each other, at any given time, in order to ensure that the RF signals conveyed to outputs 1002-1 and 1002-2 are balanced.

As discussed above, variable matching circuit 1000 is a double-ended circuit that is configured to be connected along a balanced portion of the transmission path 928 (e.g., between connectors 928-4 and 928-5), and other embodiments may include a single-ended (i.e., one input and one output) variable matching circuit that is configured to be connected along the unbalanced portion of the transmission path 928.

By varying the inductance values of inductors 1011, 1016, 1021 in circuit 1000, the system controller 912 may increase or decrease the impedance transformation provided by circuit 1000. Desirably, the inductance value changes improve the overall impedance match between the RF signal source 920 and the cavity input impedance, which should result in a reduction of the reflected signal power and/or the reflected-to-forward signal power ratio. In most cases, the system controller 912 may strive to configure the circuit 1000 in a state in which a maximum electromagnetic field intensity is achieved in the cavity 960, and/or a maximum quantity of power is absorbed by the load 964, and/or a minimum quantity of power is reflected by the load 964.

FIG. 11 is a schematic diagram of a double-ended variable impedance matching network 1100, in accordance with another example embodiment. Network 1100 includes a double-ended input 1101-1, 1101-2 (referred to as input 1101), a double-ended output 1102-1, 1102-2 (referred to as output 1102), and a network of passive components connected in a ladder arrangement between the input 1101 and output 1102. The ladder arrangement includes a first plurality, N, of discrete inductors 1111-1114 coupled in series with each other between input 1101-1 and output 1102-1, where N may be an integer between 2 and 10, or more. The ladder arrangement also includes a second plurality, N, of discrete inductors 1116-1119 coupled in series with each other between input 1101-2 and output 1102-2. Additional discrete inductors 1115 and 1120 may be coupled between intermediate nodes 1125, 1126 and the output nodes 1102-1, 1102-2. Further still, the ladder arrangement includes a third plurality of discrete inductors 1121-1123 coupled in series with each other between inputs 1101-1 and 1101-2, and an additional discrete inductor 1124 coupled between nodes 1125 and 1126. For example, the fixed inductors 1115, 1120, 1124 each may have inductance values in a range of about 50 nH to about 800 nH, although the inductance values may be lower or higher, as well.

The series arrangement of inductors 1111-1114 may be considered a first variable inductor (e.g., inductor 1011, FIG. 10), the series arrangement of inductors 1116-1119 may be considered a second variable inductor (e.g., inductor 1016, FIG. 10), and series arrangement of inductors 1121-1123 may be considered a third variable inductor (e.g., inductor 1021, FIG. 10). To control the variability of the "variable inductors", network 1100 includes a plurality of bypass switches 1131-1134, 1136-1139, 1141, and 1143, where each switch 1131-1134, 1136-1139, 1141, and 1143 is coupled in parallel across the terminals of one of inductors 1111-1114, 1116-1119, 1121, and 1123. Switches 1131-1134, 1136-1139, 1141, and 1143 may be implemented as transistors, mechanical relays or mechanical switches, for example. The electrically conductive state of each switch 1131-1134, 1136-1139, 1141, and 1143 (i.e., open or closed) is controlled using control signals 1151-1154, 1156-1159, 1161, 1163 from the system controller (e.g., control signals from system controller 912 provided over connection 916, FIG. 9).

In an embodiment, sets of corresponding inductors in the two paths between input 1101 and output 1102 have substantially equal values, and the conductive state of the switches for each set of corresponding inductors is operated in a paired manner, meaning that the switch states during operation are controlled to be the same as each other, at any given time, in order to ensure that the RF signals conveyed to outputs 1102-1 and 1102-2 are balanced. For example, inductors 1111 and 1116 may constitute a first "set of corresponding inductors" or "paired inductors" with substantially equal values, and during operation, the states of switches 1131 and 1136 are controlled to be the same (e.g., either both open or both closed), at any given time. Similarly, inductors 1112 and 1117 may constitute a second set of corresponding inductors with equal inductance values that are operated in a paired manner, inductors 1113 and 1118 may constitute a third set of corresponding inductors with equal inductance values that are operated in a paired manner, and inductors 1114 and 1119 may constitute a fourth set of corresponding inductors with equal inductance values that are operated in a paired manner.

For each parallel inductor/switch combination, substantially all current flows through the inductor when its corresponding switch is in an open or non-conductive state, and substantially all current flows through the switch when the switch is in a closed or conductive state. For example, when all switches 1131-1134, 1136-1139, 1141, and 1143 are open, as illustrated in FIG. 11, substantially all current flowing between input and output nodes 1101-1, 1102-1 flows through the series of inductors 1111-1115, and substantially all current flowing between input and output nodes 1101-2, 1102-2 flows through the series of inductors 1116-1120 (as modified by any current flowing through inductors 1121-1123 or 1124). This configuration represents the maximum inductance state of the network 1100 (i.e., the state of network 1100 in which a maximum inductance value is present between input and output nodes 1101, 1102). Conversely, when all switches 1131-1134, 1136-1139, 1141, and 1143 are closed, substantially all current flowing between input and output nodes 1101, 1102 bypasses the inductors 1111-1114 and 1116-1119 and flows instead through the switches 1131-1134 or 1136-1139, inductors 1115 or 1120, and the conductive interconnections between the input and output nodes 1101, 1102 and switches 1131-1134, 1136-1139. This configuration represents the minimum inductance state of the network 1100 (i.e., the state of network 1100 in which a minimum inductance value is present between input and output nodes 1101, 1102). Ideally, the minimum inductance value would be near zero inductance. However, in practice a relatively small inductance is present in the minimum inductance state due to the cumulative inductances of the switches 1131-1134 or 1136-1139, inductors 1115 or 1120, and the conductive interconnections between nodes 1101, 1102 and the switches 1131-1134 or 1136-1139. For example, in the minimum inductance state, a trace inductance for the series combination of switches 1131-1134 or 1136-1139 may be in a range of about 10 nH to about 400 nH, although the trace inductance may be smaller or larger, as well. Larger, smaller, or substantially similar trace inductances also may be inherent in each of the other network states, as well, where the trace inductance for any given network state is a summation of the inductances of the sequence of conductors and switches through which the current primarily is carried through the network 1100.

Starting from the maximum inductance state in which all switches 1131-1134, 1136-1139 are open, the system controller may provide control signals 1151-1154, 1156-1159 that result in the closure of any combination of switches 1131-1134, 1136-1139 in order to reduce the inductance of the network 1100 by bypassing corresponding combinations of inductors 1111-1114, 1116-1119.

Similar to the embodiment of FIG. 10, in circuit 1100, the first and second pluralities of discrete inductors 1111-1114, 1116-1119 and fixed inductor 1124 correspond to a "cavity matching portion" of the circuit. Similar to the embodiment described above in conjunction with FIG. 5, in one embodiment, each inductor 1111-1114, 1116-1119 has substantially the same inductance value, referred to herein as a normalized value of I. For example, each inductor 1111-1114, 1116-1119 may have a value in a range of about 1 nH to about 400 nH, or some other value. In such an embodiment, the maximum inductance value between input node 1101-1 and 1102-2, and the maximum inductance value between input node 1101-2 and 1102-2 (i.e., when all switches 1131-1134, 1136-1139 are in an open state) would be about NxJ, plus any trace inductance that may be present in the network 1100 when it is in the maximum inductance state. When any n switches are in a closed state, the inductance value between corresponding input and output nodes would be about (N−n)×I (plus trace inductance).

As also explained in conjunction with FIG. 5, above, in an alternate embodiment, the inductors 1111-1114, 1116-1119 may have different values from each other. For example, moving from the input node 1101-1 toward the output node 1102-1, the first inductor 1111 may have a normalized inductance value of I, and each subsequent inductor 1112-1114 in the series may have a larger or smaller inductance value. Similarly, moving from the input node 1101-2 toward the output node 1102-2, the first inductor 1116 may have a normalized inductance value of I, and each subsequent inductor 1117-1119 in the series may have a larger or smaller inductance value. For example, each subsequent inductor 1112-1114 or 1117-1119 may have an inductance value that is a multiple (e.g., about twice or half) the inductance value of the nearest downstream inductor 1111-1114 or 1116-1118. The example of Table 1, above, applies also to the first series inductance path between input and output nodes 1101-1 and 1102-1, and the second series inductance path between input and output nodes 1101-2 and 1102-1. More specifically, inductor/switch combinations 1111/1131 and 1116/1156 each are analogous to inductor/switch combination 501/511, inductor/switch combinations 1112/1132 and 1117/1157 each are analogous to inductor/switch combination 502/512, inductor/switch combinations 1113/1133 and 1118/1158 each are analogous to inductor/switch combination 503/513, and inductor/switch combinations 1114/1134 and 1119/1159 each are analogous to inductor/switch combination 504/514.

Assuming that the trace inductance through series inductors 1111-1114 in the minimum inductance state is about 10 nH, and the range of inductance values achievable by the series inductors 1111-1114 is about 10 nH (trace inductance) to about 400 nH, the values of inductors 1111-1114 may be, for example, about 10 nH, about 20 nH, about 40 nH, about 80 nH, and about 160 nH, respectively. The combination of series inductors 1116-1119 may be similarly or identically configured. Of course, more or fewer than four inductors 1111-1114 or 1116-1119 may be included in either series combination between input and output nodes 1101-1/1102-1 or 1101-2/1102-2, and the inductors within each series combination may have different values from the example values given above.

Although the above example embodiment specifies that the number of switched inductances in each series combination between corresponding input and output nodes equals four, and that each inductor 1111-1114, 1116-1119 has a value that is some multiple of a value of I, alternate embodiments of variable series inductance networks may have more or fewer than four inductors, different relative values for the inductors, and/or a different configuration of inductors (e.g., differently connected sets of parallel and/or series coupled inductors). Either way, by providing a variable inductance network in an impedance matching network of a defrosting system, the system may be better able to match the ever-changing cavity input impedance that is present during a defrosting operation.

As with the embodiment of FIG. 10, the third plurality of discrete inductors 1121-1123 corresponds to an "RF signal source matching portion" of the circuit. The third variable inductor, comprising the series arrangement of inductors 1121-1123, where bypass switches 1141 and 1143 enable inductors 1121 and 1123 selectively to be connected into the series arrangement or bypassed based on control signals 1161 and 1163. In an embodiment, each of inductors 1121-

1123 may have equal values (e.g., values in a range of about 1 nH to about 100 nH. In an alternate embodiment, the inductors 1121-1123 may have different values from each other. For example, moving from the first input node 1101-1 toward the second input node 1101-2, the first inductor 1121 may have a normalized inductance value of J, and each subsequent inductor 1122, 1123 in the series may have a larger or smaller inductance value. For example, inductor 1122 may have a value of 2*J, and inductor 1123 may have a value of 4*J, in some embodiments.

It should be understood that the variable impedance matching circuits 1000, 1100 illustrated in FIGS. 10 and 11 are but two possible circuit configurations that may perform the desired double-ended variable impedance transformations. Other embodiments of double-ended variable impedance matching circuits may include differently arranged inductive networks, or may include passive networks that include inductors, capacitors, and/or resistors, where some of the passive components may be fixed-value components, and some of the passive components may be variable-value components (e.g., variable inductors, variable capacitors, and/or variable resistors). Further, the double-ended variable impedance matching circuits may include active devices (e.g., transistors) that switch passive components into and out of the network to alter the overall impedance transformation provided by the circuit.

Figure 12:
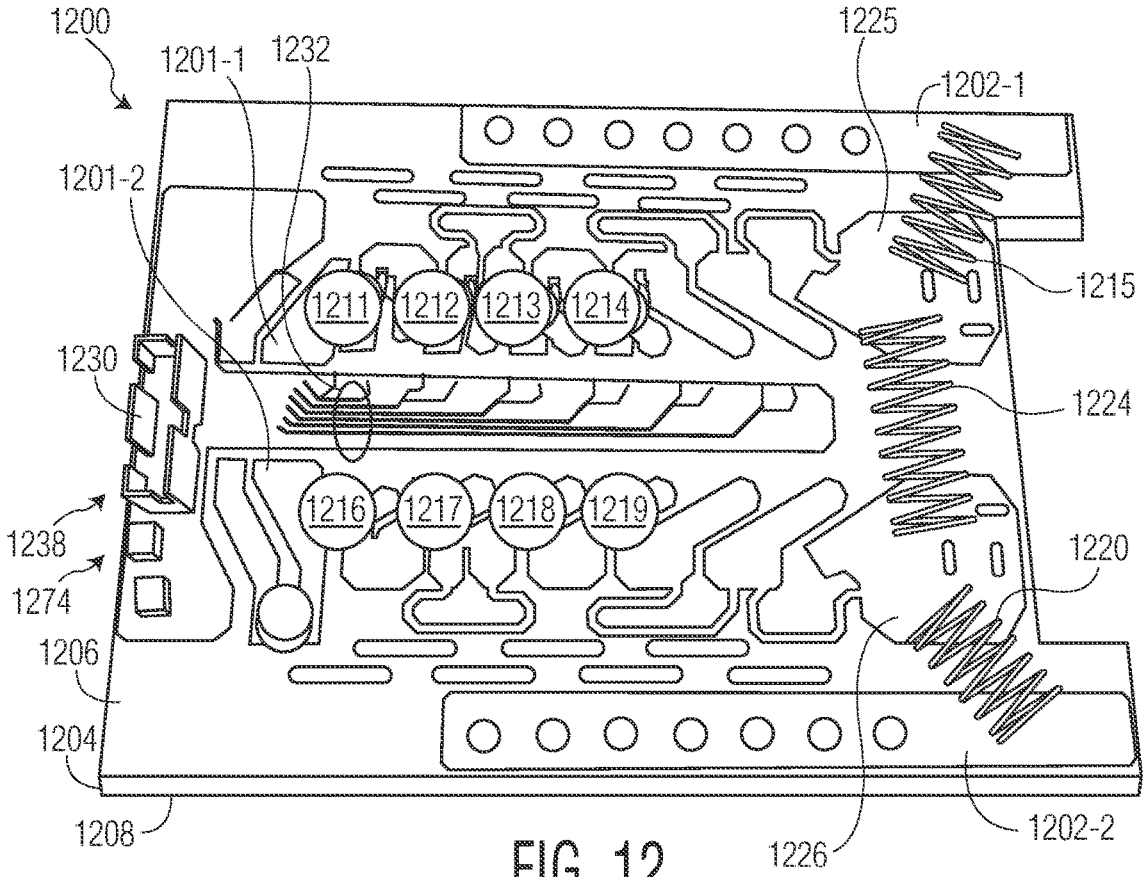
FIG. 12 is a perspective view of a double-ended variable impedance matching network module, in accordance with an example embodiment.

According to various embodiments, the circuitry associated with the single-ended or double-ended variable impedance matching networks discussed herein may be implemented in the form of one or more modules, where a "module" is defined herein as an assembly of electrical components coupled to a common substrate. For example, FIG. 12 is a perspective view of an example of a module 1200 that includes a double-ended variable impedance matching network (e.g., network 1000, 1100, FIGS. 10, 11), in accordance with an example embodiment. The module 1200 includes a printed circuit board (PCB) 1204 with a front side 1206 and an opposite back side 1208. The PCB 1204 is formed from one or more dielectric layers, and two or more printed conductive layers. Conductive vias (not visible in FIG. 12) may provide for electrical connections between the multiple conductive layers. At the front side 1206, a plurality of printed conductive traces formed from a first printed conductive layer provides for electrical connectivity between the various components that are coupled to the front side 1206 of the PCB 1204. Similarly, at the back side 1208, a plurality of printed conductive traces formed from a second printed conductive layer provides for electrical connectivity between the various components that are coupled to the back side 1208 of the PCB 1204.

According to an embodiment, the PCB 1204 houses an RF input connector 1238 (e.g., coupled to back side 1208 and thus not visible in the view of FIG. 12, but corresponding to connector 938, FIG. 9) and a balun 1274 (e.g., coupled to back side 1208 and thus not visible in the view of FIG. 12, but corresponding to balun 974, FIG. 9). The input connector 1238 is configured to be electrically connected to an RF subsystem (e.g., subsystem 310, 910, FIGS. 3, 9) with a connection (e.g., connection 928-3, FIG. 9) such as a coaxial cable or other type of conductor. In such an embodiment, an unbalanced RF signal received by the balun 1274 from the RF input connector 1238 is converted to a balanced signal, which is provided over a pair of balanced conductors (e.g., connections 928-4, FIG. 9) to a double-ended input that includes first and second inputs 1201-1, 1201-2. The connection between the input connector 1238 and the balun 1274, and the connections between the balun 1274 and the inputs 1201-1, 1201-2 each may be implemented using conductive traces and vias formed on and in the PCB 1204. In an alternate embodiment, as discussed above, an alternate embodiment may include a balanced amplifier (e.g., balanced amplifier 924', FIG. 9), which produces a balanced signal on connections (e.g., conductors 928-1', FIG. 9) that can be directly coupled to the inputs 1201-1, 1201-2. In such an embodiment, the balun 1274 may be excluded from the module 1200.

In addition, the PCB 1204 houses circuitry associated with a double-ended variable impedance matching network (e.g., network 972, 1000, 1100, FIGS. 9-11). Accordingly, the circuitry housed by the PCB 1204 includes the double-ended input 1201-1, 1201-2 (e.g., inputs 1101-1, 1101-2, FIG. 11), a double-ended output 1202-1, 1202-2 (e.g., outputs 1102-1, 1102-2, FIG. 11), a first plurality of inductors 1211, 1212, 1213, 1214, 1215 (e.g., inductors 1111-1115, FIG. 11) coupled in series between a first input 1201-1 of the double-ended input and a first output 1202-1 of the double-ended output, a second plurality of inductors 1216, 1217, 1218, 1219, 1220 (e.g., inductors 1116-1120, FIG. 11) coupled in series between a second input 1201-2 of the double-ended input and a second output 1202-2 of the double-ended output, a third plurality of inductors (not visible in the view of FIG. 12, but corresponding to inductors 1121-1123, FIG. 11, for example) coupled in series between the first and second inputs 1201-1, 1201-2, and one or more additional inductors 1224 (e.g., inductor 1124, FIG. 11) coupled between nodes 1225 and 1226 (e.g., nodes 1125, 1126).

A plurality of switches or relays (e.g., not visible in the view of FIG. 12, but corresponding to switches 1131-1134, 1136-1139, 1141, 1143, FIG. 11, for example) may be coupled to the back side 1208 of the PCB 1204. Each of the switches or relays is electrically connected in parallel across one of the inductors 1211-1214, 1216-1219, or one of the inductors (e.g., inductors 1121, 1123, FIG. 11) between inputs 1202-1 and 1202-2, in an embodiment. A control connector 1230 is coupled to the PCB 1204, and conductors of the control connector 1230 are electrically coupled to conductive traces 1232 to provide control signals to the switches (e.g., control signals 1151-1154, 1156-1159, 1161, 1163, FIG. 11), and thus to switch the inductors into or out of the circuit, as described previously. As shown in FIG. 12, fixed-value inductors 1215, 1220 (e.g., inductors 1115, 1120, FIG. 11) may be formed from relatively large coils, although they may be implemented using other structures as well. As shown in the embodiment of FIG. 12, the conductive features corresponding to outputs 1202-1, 1202-2 may be relatively large, and may be elongated for direct attachment to the electrodes (e.g., electrodes 940, 950, FIG. 9) of the system.

Figure 13:
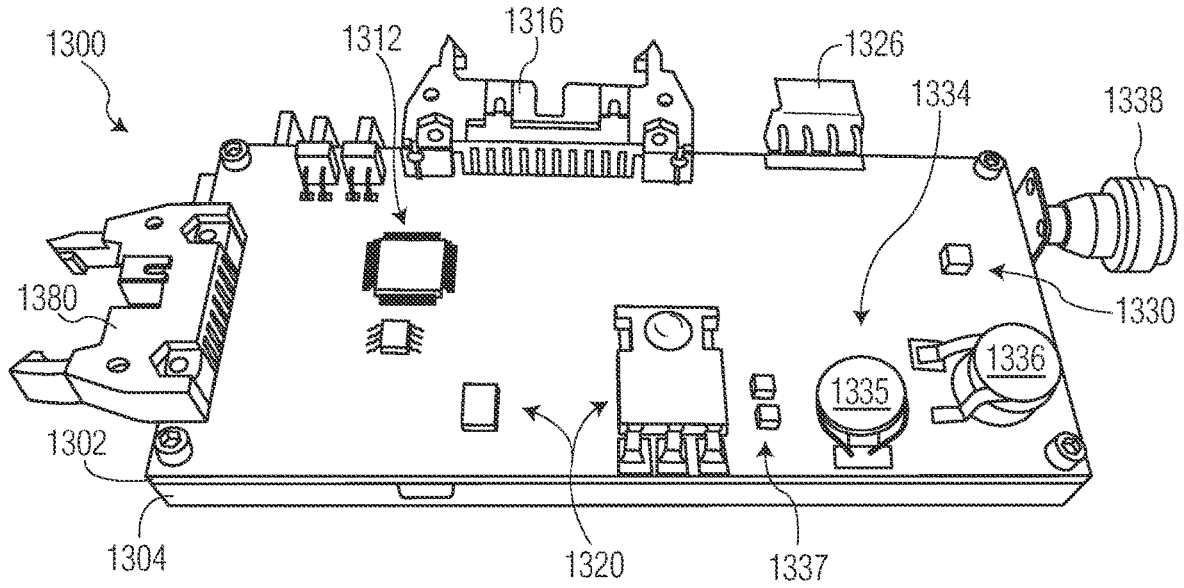
FIG. 13 is a perspective view of an RF module, in accordance with an example embodiment.

In various embodiments, the circuitry associated with the RF subsystem (e.g., RF subsystem 310, 910, FIGS. 3, 9) also may be implemented in the form of one or more modules. For example, FIG. 13 is a perspective view of an RF module 1300 that includes an RF subsystem (e.g., RF subsystem 310, 910, FIGS. 3, 9), in accordance with an example embodiment. The RF module 1300 includes a PCB 1302 coupled to a ground substrate 1304. The ground substrate 1304 provides structural support for the PCB 1302, and also provides an electrical ground reference and heat sink functionality for the various electrical components coupled to the PCB 1302.

According to an embodiment, the PCB 1302 houses the circuitry associated with the RF subsystem (e.g., subsystem 310 or 910, FIGS. 3, 9). Accordingly, the circuitry housed by the PCB 1302 includes system controller circuitry 1312 (e.g., corresponding to system controller 312, 912, FIGS. 3, 9), RF signal source circuitry 1320 (e.g., corresponding to RF signal source 320, 920, FIGS. 3, 9, including an RF signal generator 322, 922 and power amplifier 324, 325, 924), power detection circuitry 1330 (e.g., corresponding to power detection circuitry 330, 930, FIGS. 3, 9), and impedance matching circuitry 1334 (e.g., corresponding to first matching circuitry 334, 934, FIGS. 3, 9).

In the embodiment of FIG. 13, the system controller circuitry 1312 includes a processor IC and a memory IC, the RF signal source circuitry 1320 includes a signal generator IC and one or more power amplifier devices, the power detection circuitry 1330 includes a power coupler device, and the impedance matching circuitry 1334 includes a plurality of passive components (e.g., inductors 1335, 1336 and capacitors 1337) connected together to form an impedance matching network. The circuitry 1312, 1320, 1330, 1334 and the various sub-components may be electrically coupled together through conductive traces on the PCB 1302 as discussed previously in reference to the various conductors and connections discussed in conjunction with FIGS. 3, 9.

RF module 1300 also includes a plurality of connectors 1316, 1326, 1338, 1380, in an embodiment. For example, connector 1380 may be configured to connect with a host system that includes a user interface (e.g., user interface 380, 980, FIGS. 3, 9) and other functionality. Connector 1316 may be configured to connect with a variable matching circuit (e.g., circuit 372, 972, FIGS. 3, 9) to provide control signals to the circuit, as previously described. Connector 1326 may be configured to connect to a power supply to receive system power. Finally, connector 1338 (e.g., connector 336, 936, FIGS. 3, 9) may be configured to connect to a coaxial cable or other transmission line, which enables the RF module 1300 to be electrically connected (e.g., through a coaxial cable implementation of conductor 328-2, 928-3, FIGS. 3, 9) to a variable matching subsystem (e.g., subsystem 370, 970, FIGS. 3, 9). In an alternate embodiment, components of the variable matching subsystem (e.g., variable matching network 370, balun 974, and/or variable matching circuit 972, FIGS. 3, 9) also may be integrated onto the PCB 1302, in which case connector 1336 may be excluded from the module 1300. Other variations in the layout, subsystems, and components of RF module 1300 may be made, as well.

Embodiments of an RF module (e.g., module 1300, FIG. 13) and a variable impedance matching network module (e.g., module 1200, FIG. 12) may be electrically connected together, and connected with other components, to form a defrosting apparatus or system (e.g., apparatus 100, 200, 300, 900, FIGS. 1-3, 9). For example, an RF signal connection may be made through a connection (e.g., conductor 928-3, FIG. 9), such as a coaxial cable, between the RF connector 1338 (FIG. 13) and the RF connector 1238 (FIG. 12), and control connections may be made through connections (e.g., conductors 916, FIG. 9), such as a multi-conductor cable, between the connector 1316 (FIG. 13) and the connector 1230 (FIG. 12). To further assemble the system, a host system or user interface may be connected to the RF module 1300 through connector 1380, a power supply may be connected to the RF module 1300 through connector 1326, and electrodes (e.g., electrodes 940, 950, FIG. 9) may be connected to the outputs 1202-1, 1202-2. Of course, the above-described assembly also would be physically connected to various support structures and other system components so that the electrodes are held in a fixed relationship to each other across a defrosting cavity (e.g., cavity 110, 360, 960, FIGS. 1, 3, 9), and the defrosting apparatus may be integrated within a larger system (e.g., systems 100, 200, FIGS. 1, 2).

Figure 14:
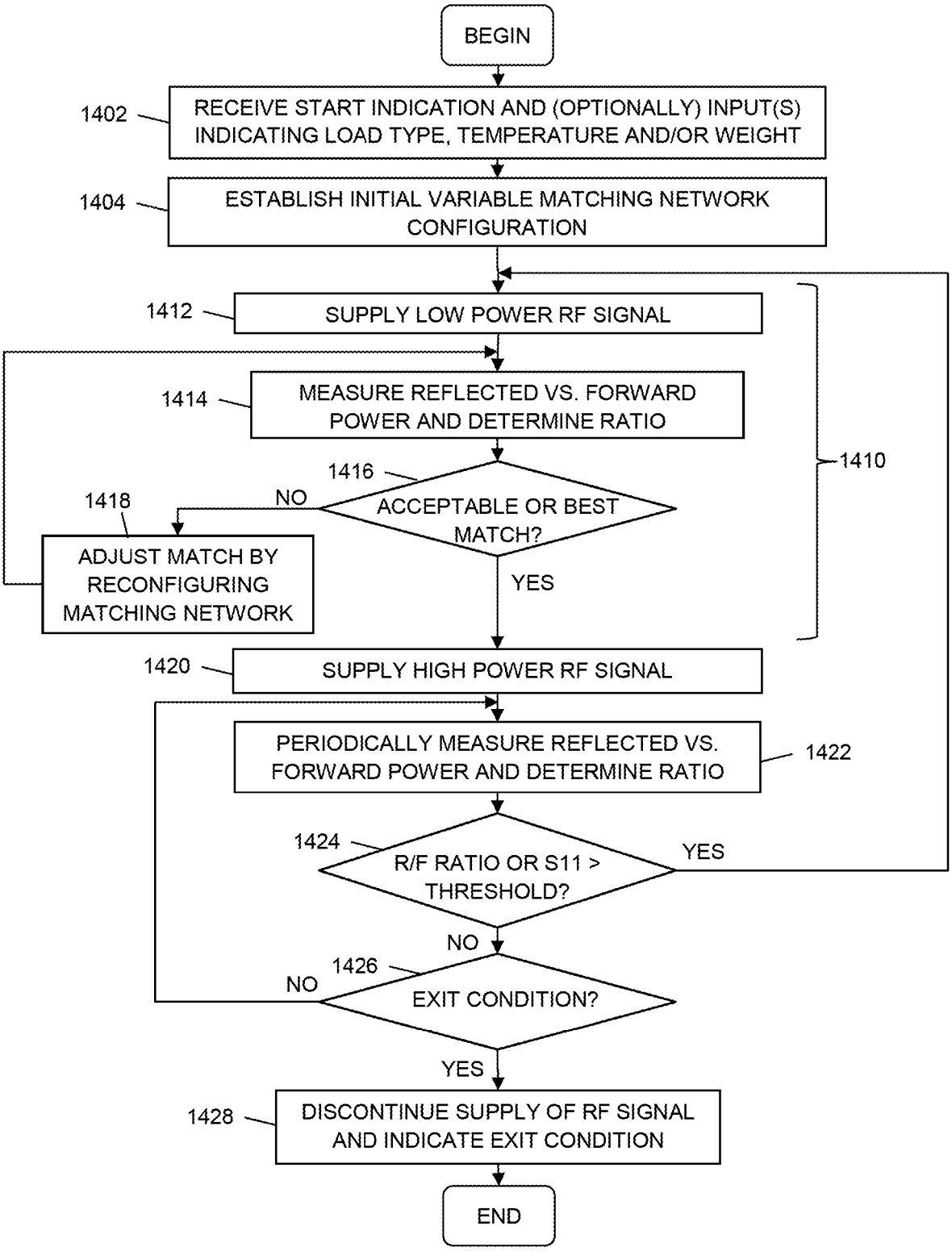
FIG. 14 is a flowchart of a method of operating a defrosting system with dynamic load matching, in accordance with an example embodiment.

Now that embodiments of the electrical and physical aspects of defrosting systems have been described, various embodiments of methods for operating such defrosting systems will now be described in conjunction with FIGS. 14 and 15. More specifically, FIG. 14 is a flowchart of a method of operating a defrosting system (e.g., system 100, 210, 220, 300, 700, 900, FIGS. 1-3, 7, 9) with dynamic load matching, in accordance with an example embodiment.

The method may begin, in block 1402, when the system controller (e.g., system controller 312, 912, FIGS. 3, 9) receives an indication that a defrosting operation should start. Such an indication may be received, for example, after a user has place a load (e.g., load 364, 964, FIGS. 3, 9) into the system's defrosting cavity (e.g., cavity 360, 960, FIGS. 3, 9), has sealed the cavity (e.g., by closing a door or drawer), and has pressed a start button (e.g., of the user interface 380, 980, FIGS. 3, 9). In an embodiment, sealing of the cavity may engage one or more safety interlock mechanisms, which when engaged, indicate that RF power supplied to the cavity will not substantially leak into the environment outside of the cavity. As will be described later, disengagement of a safety interlock mechanism may cause the system controller immediately to pause or terminate the defrosting operation.

According to various embodiments, the system controller optionally may receive additional inputs indicating the load type (e.g., meats, liquids, or other materials), the initial load temperature, and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the initial load temperature may be received, for example, from one or more temperature sensors and/or IR sensors (e.g., sensors 390, 792, 990, FIGS. 3, 7, 9) of the system. Information regarding the load weight may be received from the user through interaction with the user interface, or from a weight sensor (e.g., sensor 390, 790, 990, FIGS. 3, 7, 9) of the system. As indicated above, receipt of inputs indicating the load type, initial load temperature, and/or load weight is optional, and the system alternatively may not receive some or all of these inputs.

In block 1404, the system controller provides control signals to the variable matching network (e.g., network 370, 400, 972, 1000, 1100, FIGS. 3, 4, 9-11) to establish an initial configuration or state for the variable matching network. As described in detail in conjunction with FIGS. 4, 5, 10, and 11, the control signals affect the inductances of variable matching networks (e.g., networks 410, 411, 1011, 1016, 1021, FIGS. 4, 10) within the variable matching network. For example, the control signals may affect the states of bypass switches (e.g., switches 511-514, 1131-1134, 1136-1139, 1141, 1143, FIGS. 5, 11), which are responsive to the control signals from the system controller (e.g., control signals 521-524, 1151-1154, 1156-1159, 1161, 1163, FIGS. 5, 11).

As also discussed previously, a first portion of the variable matching network may be configured to provide a match for the RF signal source (e.g., RF signal source 320, 920, FIGS. 3, 9) or the final stage power amplifier (e.g., power amplifier 325, 924, FIGS. 3, 9), and a second portion of the variable matching network may be configured to provide a match for the cavity (e.g., cavity 360, 960, FIGS. 3, 9) plus the load (e.g., load 364, 964, FIGS. 3, 9). For example, referring to FIG. 4, a first shunt, variable inductance network 410 may be configured to provide the RF signal source match, and a second shunt, variable inductance network 416 may be configured to provide the cavity plus load match.

It has been observed that a best initial overall match for a frozen load (i.e., a match at which a maximum amount of RF power is absorbed by the load) typically has a relatively high inductance for the cavity matching portion of the matching network, and a relatively low inductance for the RF signal source matching portion of the matching network. For example, FIG. 15 is a chart plotting optimal cavity match setting versus RF signal source match setting through a defrost operation for two different loads, where trace 1510 corresponds to a first load (e.g., having a first type, weight, and so on), and trace 1520 corresponds to a second load (e.g., having a second type, weight, and so on). In FIG. 15, the optimal initial match settings for the two loads at the beginning of a defrost operation (e.g., when the loads are frozen) are indicated by points 1512 and 1522, respectively. As can be seen, both points 1512 and 1522 indicate relatively high cavity match settings in comparison to relatively low RF source match settings. Referring to the embodiment of FIG. 4, this translates to a relatively high inductance for variable inductance network 416, and a relatively low inductance for variable inductance network 410. Referring to the embodiment of FIG. 10, this translates to a relatively high inductance for variable inductance networks 1011 and 1016, and a relatively low inductance for variable inductance network 1021.

According to an embodiment, to establish the initial configuration or state for the variable matching network in block 1404, the system controller sends control signals to the first and second variable inductance networks (e.g., networks 410, 411, FIG. 4) to cause the variable inductance network for the RF signal source match (e.g., network 410) to have a relatively low inductance, and to cause the variable inductance network for the cavity match (e.g., network 411) to have a relatively high inductance. The system controller may determine how low or how high the inductances are set based on load type/weight/temperature information known to the system controller a priori. If no a priori load type/weight/temperature information is available to the system controller, the system controller may select a relatively low default inductance for the RF signal source match and a relatively high default inductance for the cavity match.

Assuming, however, that the system controller does have a priori information regarding the load characteristics, the system controller may attempt to establish an initial configuration near the optimal initial matching point. For example, and referring again to FIG. 15, the optimal initial matching point 1512 for the first type of load has a cavity match (e.g., implemented by network 411 or 1011/1016) of about 80 percent of the network's maximum value, and has an RF signal source match (e.g., implemented by network 410 or 1021) of about 10 percent of the network's maximum value. Assuming each of the variable inductance networks has a structure similar to the network 500 of FIG. 5, for example, and assuming that the states from Table 1, above, apply, then for the first type of load, system controller may initialize the variable inductance network so that the cavity match network (e.g., network 411 or 1011/1016) has state 12 (i.e., about 80 percent of the maximum possible inductance of network 411 or 1011/1016), and the RF signal source match network (e.g., network 410 or 1021) has state 2 (i.e., about 10 percent of the maximum possible inductance of network 410). Conversely, the optimal initial matching point 1522 for the second type of load has a cavity match (e.g., implemented by network 411 or 1011/1016) of about 40 percent of the network's maximum value, and has an RF signal source match (e.g., implemented by network 410 or 1021) of about 10 percent of the network's maximum value. Accordingly, for the second type of load, system controller may initialize the variable inductance network so that the cavity match network (e.g., network 411 or 1011/1016) has state 6 (i.e., about 40 percent of the maximum possible inductance of network 411 or 1011/1016), and the RF signal source match network (e.g., network 410 or 1021) has state 2 (i.e., about 10 percent of the maximum possible inductance of network 410 or 1021). Generally, during a defrosting operation, adjustments to the impedance values of the RF signal source match network and the cavity match network are made in an inverse manner. In other words, when the impedance value of the RF signal source match network is decreased, the impedance value of the cavity match network is increased, and vice versa.

Referring again to FIG. 14, once the initial variable matching network configuration is established, the system controller may perform a process 1410 of adjusting, if necessary, the configuration of the variable impedance matching network to find an acceptable or best match based on actual measurements that are indicative of the quality of the match. According to an embodiment, this process includes causing the RF signal source (e.g., RF signal source 320, 920, FIGS. 3, 9) to supply a relatively low power RF signal through the variable impedance matching network to the electrode(s) (e.g., first electrode 340 or both electrodes 940, 950, FIGS. 3, 9), in block 1412. The system controller may control the RF signal power level through control signals to the power supply and bias circuitry (e.g., circuitry 326, 926, FIGS. 3, 9), where the control signals cause the power supply and bias circuitry to provide supply and bias voltages to the amplifiers (e.g., amplifier stages 324, 325, 924, FIGS. 3, 9) that are consistent with the desired signal power level. For example, the relatively low power RF signal may be a signal having a power level in a range of about 10 W to about 20 W, although different power levels alternatively may be used. A relatively low power level signal during the match adjustment process 1410 is desirable to reduce the risk of damaging the cavity or load (e.g., if the initial match causes high reflected power), and to reduce the risk of damaging the switching components of the variable inductance networks (e.g., due to arcing across the switch contacts).

In block 1414, power detection circuitry (e.g., power detection circuitry 330, 930, 930', 930", FIGS. 3, 9) then measures the reflected and (in some embodiments) forward power along the transmission path (e.g., path 328, 928, FIGS. 3, 9) between the RF signal source and the electrode (s), and provides those measurements to the system controller. The system controller may then determine a ratio between the reflected and forward signal powers, and may determine the S11 parameter for the system based on the ratio. The system controller may store the received power measurements (e.g., the received reflected power measurements, the received forward power measurement, or both), and/or the calculated ratios, and/or S11 parameters for future evaluation or comparison, in an embodiment.

In block 1416, the system controller may determine, based on the reflected power measurements, and/or the reflected-to-forward signal power ratio, and/or the S11 parameter, whether or not the match provided by the variable impedance matching network is acceptable (e.g., the reflected power is below a threshold, or the ratio is 10 percent or less, or the measurements or values compare favorably with some other criteria). Alternatively, the system controller may be configured to determine whether the match is the "best" match. A "best" match may be determined, for example, by iteratively measuring the reflected RF power (and in some embodiments the forward reflected RF power) for all possible impedance matching network configurations (or at least for a defined subset of impedance matching network configurations), and determining which configuration results in the lowest reflected RF power and/or the lowest reflected-to-forward power ratio.

When the system controller determines that the match is not acceptable or is not the best match, the system controller may adjust the match, in block 1418, by reconfiguring the variable impedance matching network. For example, this may be achieved by sending control signals to the variable impedance matching network, which cause the network to increase and/or decrease the variable inductances within the network (e.g., by causing the variable inductance networks 410, 411, 1011, 1016, 1021 to have different inductance states, or by switching inductors 501-504, 1111-1114, 1116-1119, 1121, 1123, FIGS. 4, 5, 10, 11 into or out of the circuit). After reconfiguring the variable inductance network, blocks 1414, 1416, and 1418 may be iteratively performed until an acceptable or best match is determined in block 1416.

Once an acceptable or best match is determined, the defrosting operation may commence. Commencement of the defrosting operation includes increasing the power of the RF signal supplied by the RF signal source (e.g., RF signal source 320, 920, FIGS. 3, 9) to a relatively high power RF signal, in block 1420. Once again, the system controller may control the RF signal power level through control signals to the power supply and bias circuitry (e.g., circuitry 326, 926, FIGS. 3, 9), where the control signals cause the power supply and bias circuitry to provide supply and bias voltages to the amplifiers (e.g., amplifier stages 324, 325, 924, FIGS. 3, 9) that are consistent with the desired signal power level. For example, the relatively high power RF signal may be a signal having a power level in a range of about 50 W to about 500 W, although different power levels alternatively may be used.

In block 1422, power detection circuitry (e.g., power detection circuitry 330, 930, 930', 930", FIGS. 3, 9) then periodically measures the reflected power and, in some embodiments, the forward power along the transmission path (e.g., path 328, 928, FIGS. 3, 9) between the RF signal source and the electrode(s), and provides those measurements to the system controller. The system controller again may determine a ratio between the reflected and forward signal powers, and may determine the S11 parameter for the system based on the ratio. The system controller may store the received power measurements, and/or the calculated ratios, and/or S11 parameters for future evaluation or comparison, in an embodiment. According to an embodiment, the periodic measurements of the forward and reflected power may be taken at a fairly high frequency (e.g., on the order of milliseconds) or at a fairly low frequency (e.g., on the order of seconds). For example, a fairly low frequency for taking the periodic measurements may be a rate of one measurement every 10 seconds to 20 seconds.

In block 1424, the system controller may determine, based on one or more reflected signal power measurements, one or more calculated reflected-to-forward signal power ratios, and/or one or more calculated S11 parameters, whether or not the match provided by the variable impedance matching network is acceptable. For example, the system controller may use a single reflected signal power measurement, a single calculated reflected-to-forward signal power ratio, or a single calculated S11 parameter in making this determination, or may take an average (or other calculation) of a number of previously-received reflected signal power measurements, previously-calculated reflected-to-forward power ratios, or previously-calculated S11 parameters in making this determination. To determine whether or not the match is acceptable, the system controller may compare the received reflected signal power, the calculated ratio, and/or S11 parameter to one or more corresponding thresholds, for example. For example, in one embodiment, the system controller may compare the received reflected signal power to a threshold of, for example, 5 percent (or some other value) of the forward signal power. A reflected signal power below 5 percent of the forward signal power may indicate that the match remains acceptable, and a ratio above 5 percent may indicate that the match is no longer acceptable. In another embodiment, the system controller may compare the calculated reflected-to-forward signal power ratio to a threshold of 10 percent (or some other value). A ratio below 10 percent may indicate that the match remains acceptable, and a ratio above 10 percent may indicate that the match is no longer acceptable. When the measured reflected power, or the calculated ratio or S11 parameter is greater than the corresponding threshold (i.e., the comparison is unfavorable), indicating an unacceptable match, then the system controller may initiate re-configuration of the variable impedance matching network by again performing process 1410.

As discussed previously, the match provided by the variable impedance matching network may degrade over the course of a defrosting operation due to impedance changes of the load (e.g., load 364, FIG. 3) as the load warms up. It has been observed that, over the course of a defrosting operation, an optimal cavity match may be maintained by decreasing the cavity match inductance (e.g., by decreasing the inductance of variable inductance network 411, FIG. 4) and by increasing the RF signal source inductance (e.g., by increasing the inductance of variable inductance network 410, FIG. 4). Referring again to FIG. 15, for example, an optimal match for the first type of load at the end of a defrosting operation is indicated by point 1514, and an optimal match for the second type of load at the end of a defrosting operation is indicated by point 1524. In both cases, tracking of the optimal match between initiation and completion of the defrosting operations involves gradually decreasing the inductance of the cavity match and increasing the inductance of the RF signal source match.

According to an embodiment, in the iterative process 1410 of re-configuring the variable impedance matching network, the system controller may take into consideration this tendency. More particularly, when adjusting the match by reconfiguring the variable impedance matching network in block 1418, the system controller initially may select states of the variable inductance networks for the cavity and RF signal source matches that correspond to lower inductances (for the cavity match, or network 411, FIG. 4) and higher inductances (for the RF signal source match, or network 410, FIG. 4). By selecting impedances that tend to follow the expected optimal match trajectories (e.g., those illustrated in FIG. 15), the time to perform the variable impedance matching network reconfiguration process 1410 may be reduced, when compared with a reconfiguration process that does not take these tendencies into account.

In an alternate embodiment, the system controller may instead iteratively test each adjacent configuration to attempt to determine an acceptable configuration. For example, referring again to Table 1, above, if the current configuration corresponds to state 12 for the cavity matching network and to state 3 for the RF signal source matching network, the system controller may test states 11 and/or 13 for the cavity matching network, and may test states 2 and/or 4 for the RF signal source matching network. If those tests do not yield a favorable result (i.e., an acceptable match), the system controller may test states 10 and/or 14 for the cavity matching network, and may test states 1 and/or 5 for the RF signal source matching network, and so on.

In actuality, there are a variety of different searching methods that the system controller may employ to reconfigure the system to have an acceptable impedance match, including testing all possible variable impedance matching network configurations. Any reasonable method of searching for an acceptable configuration is considered to fall within the scope of the inventive subject matter. In any event, once an acceptable match is determined in block 1416, the defrosting operation is resumed in block 1414, and the process continues to iterate.

Referring back to block 1424, when the system controller determines, based on one or more reflected power measurements, one or more calculated reflected-to-forward signal power ratios, and/or one or more calculated S11 parameters, that the match provided by the variable impedance matching network is still acceptable (e.g., the reflected power measurements, calculated ratio, or S11 parameter is less than a corresponding threshold, or the comparison is favorable), the system may evaluate whether or not an exit condition has occurred, in block 1426. In actuality, determination of whether an exit condition has occurred may be an interrupt driven process that may occur at any point during the defrosting process. However, for the purposes of including it in the flowchart of FIG. 14, the process is shown to occur after block 1424.

In any event, several conditions may warrant cessation of the defrosting operation. For example, the system may determine that an exit condition has occurred when a safety interlock is breached. Alternatively, the system may determine that an exit condition has occurred upon expiration of a timer that was set by the user (e.g., through user interface 380, 980, FIGS. 3, 9) or upon expiration of a timer that was established by the system controller based on the system controller's estimate of how long the defrosting operation should be performed. In still another alternate embodiment, the system may otherwise detect completion of the defrosting operation.

If an exit condition has not occurred, then the defrosting operation may continue by iteratively performing blocks 1422 and 1424 (and the matching network reconfiguration process 1410, as necessary). When an exit condition has occurred, then in block 1428, the system controller causes the supply of the RF signal by the RF signal source to be discontinued. For example, the system controller may disable the RF signal generator (e.g., RF signal generator 322, 922, FIGS. 3, 9) and/or may cause the power supply and bias circuitry (e.g., circuitry 326, 926, FIGS. 3, 9) to discontinue provision of the supply current. In addition, the system controller may send signals to the user interface (e.g., user interface 380, 980, FIGS. 3, 9) that cause the user interface to produce a user-perceptible indicia of the exit condition (e.g., by displaying "door open" or "done" on a display device, or providing an audible tone). The method may then end.

It should be understood that the order of operations associated with the blocks depicted in FIG. 14 corresponds to an example embodiment, and should not be construed to limit the sequence of operations only to the illustrated order. Instead, some operations may be performed in different orders, and/or some operations may be performed in parallel.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

An embodiment of a thermal increase system is coupled to a cavity for containing a load. The thermal increase system includes an RF signal source configured to supply an RF signal, a transmission path, an impedance matching network, power detection circuitry, and a controller. The transmission path is electrically coupled between the RF signal source and first and second electrodes that are positioned across the cavity. The impedance matching is electrically coupled along the transmission path, and the impedance matching network comprises a network of variable passive components. The power detection circuitry is configured to detect reflected signal power along the transmission path. The controller is configured to modify, based on the reflected signal power, one or more values of one or more of the variable passive components of the impedance matching network to reduce the reflected signal power.

An embodiment of a method of operating a thermal increase system that includes a cavity includes supplying, by an RF signal source, one or more RF signals to a transmission path that is electrically coupled between the RF signal source and first and second electrodes that are positioned across the cavity. The method further includes detecting, by power detection circuitry, reflected signal power along the transmission path, and modifying, by a controller, one or more values of one or more of variable passive components of an impedance matching network that is electrically coupled along the transmission path to reduce the reflected signal power.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A thermal increase system coupled to a cavity for containing a load, the thermal increase system comprising:

a radio frequency (RF) signal source configured to supply an RF signal;

a transmission path electrically coupled between the RF signal source and first and second electrodes that are positioned across the cavity;

a double-ended impedance matching network electrically coupled along the transmission path, wherein the double-ended impedance matching network comprises first and second inputs, a network of variable passive components including a variable inductance coupled between the first and second inputs, a first output coupled to the first electrode and configured to produce a first balanced RF signal based on the RF signal, and a second output coupled to the second electrode and configured to produce a second balanced RF signal based on the RF signal, wherein the first balanced RF signal and the second balanced RF signal are referenced against each other to have a phase difference between 120 and 240 degrees;

power detection circuitry configured to detect reflected signal power along the transmission path; and a controller configured to modify, based on the reflected signal power, one or more values of one or more of the variable passive components of the impedance matching network to reduce the reflected signal power, wherein the one or more values includes an inductance of the variable inductance.

2. The thermal increase system of claim 1, wherein the RF signal source is configured to produce an unbalanced RF signal, and the system further comprises:

a conversion apparatus with an input coupled to an output of the RF signal source and two outputs coupled through the double-ended impedance matching network to the first and second electrodes, wherein the conversion apparatus is configured to receive the unbalanced RF signal at the input, to convert the unbalanced RF signal into a balanced RF signal comprised of the first and second balanced RF signals, and to produce the first and second balanced RF signals at the two outputs.

3. The thermal increase system of claim 2, wherein the conversion apparatus comprises a balun.

4. The thermal increase system of claim 1, wherein the RF signal source includes a balanced amplifier configured to produce the first and second balanced RF signals at two outputs of the RF signal source, wherein the two outputs are coupled through the double-ended impedance matching network to the first and second electrodes.

5. The thermal increase system of claim 1, wherein the double-ended variable impedance matching network comprises:

a first variable impedance circuit connected between the first input and the first output; and a second variable impedance circuit connected between the second input and the second output.

6. The thermal increase system of claim 5, wherein:

the first variable impedance circuit includes a plurality of first passive components connected in series between the first input and the first output, and a plurality of first bypass switches, wherein each of the first bypass switches is connected in parallel across terminals of one of the first passive components, and an electrically conductive state of each of the first bypass switches is controlled through a control signal from the controller; and the second variable impedance circuit includes a plurality of second passive components connected in series between the second input and the second output, and a plurality of second bypass switches, wherein each of the second bypass switches is connected in parallel across terminals of one of the second passive components, and an electrically conductive state of each of the second bypass switches is controlled through a control signal from the controller.

7. The thermal increase system of claim 6, wherein:

the first passive components include at least a first inductor coupled in series with a second inductor;

the second passive components include at least a third inductor coupled in series with a fourth inductor;

the first and third inductors constitute a first set of paired inductors with equal values and, during operation of the system, the operational states of a first bypass switch connected across the first inductor and a third bypass switch connected across the third inductor are controlled to be the same; and the second and fourth inductors constitute a second set of paired inductors with equal values and, during operation of the system, the operational states of a second bypass switch connected across the second inductor and a fourth bypass switch connected across the fourth inductor are controlled to be the same.

8. The thermal increase system of claim 6, wherein:

the first passive components comprises a plurality of inductors coupled in series between the first input and the first output.

9. The thermal increase system of claim 8, wherein at least some of the plurality of inductors have different inductance values.

10. The thermal increase system of claim 1, wherein:

the power detection circuitry is further configured to detect the forward signal power along the transmission path; and the controller is configured to modify the one or more values of the one or more of the variable passive components based on the reflected signal power and the forward signal power.

11. A method of operating a thermal increase system that includes a cavity, the method comprising:

supplying, by a radio frequency (RF) signal source, one or more RF signals to a transmission path that is electrically coupled between the RF signal source and first and second electrodes that are positioned across the cavity;

detecting, by power detection circuitry, reflected signal power along the transmission path; and modifying, by a controller, one or more values of one or more of variable passive components of an impedance matching network that is electrically coupled along the transmission path to reduce the reflected signal power, wherein the impedance matching network is a double-ended impedance matching network electrically coupled along the transmission path, wherein the double-ended impedance matching network comprises first and second inputs, a network of variable passive components including a variable inductance coupled between the first and second inputs, a first output coupled to the first electrode and configured to produce a first balanced RF signal based on the RF signal, and a second output coupled to the second electrode and configured to produce a second balanced RF signal based on the RF signal, wherein the first balanced RF signal and the second balanced RF signal are referenced against each other to have a phase difference between 120 and 240 degrees, wherein the one or more values includes an inductance of the variable inductance.

12. The method of claim 11, wherein the RF signal source is configured to produce an unbalanced RF signal, and the method further comprises:

converting, by a conversion apparatus, the unbalanced RF signal into a balanced RF signal comprised of first and second balanced RF signals; and conveying the first balanced RF signal to the first electrode; and conveying the second balanced signal to the second electrode.

13. The method of claim 11, wherein the double-ended variable impedance matching network includes first and second outputs, a first variable impedance circuit connected between the first input and the first output, and a second variable impedance circuit connected between the second input and the second output, and wherein the method further comprises:

sending control signals to a plurality of first bypass switches to control electrically conductive states of the first bypass switches, wherein each of the first bypass switches is connected in parallel across terminals of a different passive component of the first variable impedance circuit; and sending control signals to a plurality of second bypass switches to control electrically conductive states of the second bypass switches, wherein each of the second bypass switches is connected in parallel across terminals of a different passive component of the second variable impedance circuit.

14. The method of claim 13, wherein:

the first variable impedance circuit includes at least a first inductor coupled in series with a second inductor;

the second variable impedance circuit includes at least a third inductor coupled in series with a fourth inductor;

the first and third inductors constitute a first set of paired inductors with equal values and, during operation of the system, the operational states of a first bypass switch connected across the first inductor and a third bypass switch connected across the third inductor are controlled to be the same; and the second and fourth inductors constitute a second set of paired inductors with equal values and, during operation of the system, the operational states of a second bypass switch connected across the second inductor and a fourth bypass switch connected across the fourth inductor are controlled to be the same.

* * * * *